US009393795B2

(12) United States Patent
Yamada et al.

(10) Patent No.: US 9,393,795 B2
(45) **Date of Patent: *Jul. 19, 2016**

(54) FLUID DISCHARGE DEVICE AND METHOD OF CONTROLLING A FLUID DISCHARGE DEVICE

(71) Applicant: Seiko Epson Corporation, Tokyo (JP)

(72) Inventors: Manabu Yamada, Suwa (JP); Yuichi Urabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/447,127

(22) Filed: Jul. 30, 2014

(65) Prior Publication Data

US 2014/0340439 A1 Nov. 20, 2014

Related U.S. Application Data

(62) Division of application No. 12/491,591, filed on Jun. 25, 2009, now Pat. No. 8,827,431.

(30) Foreign Application Priority Data

| | | |
|---|---|---|
| Jun. 26, 2008 | (JP) | 2008-167363 |
| Jun. 27, 2008 | (JP) | 2008-168954 |
| Sep. 22, 2008 | (JP) | 2008-243151 |
| Jun. 11, 2009 | (JP) | 2009-140009 |

(51) Int. Cl.
*B41J 2/175* (2006.01)

(52) U.S. Cl.
CPC ..... *B41J 2/17509* (2013.01); *B41J 2/17513* (2013.01); *B41J 2/17566* (2013.01)

(58) Field of Classification Search
CPC ..... B41J 2/17509
USPC ..... 347/7, 30, 85, 86
See application file for complete search history.

(56) References Cited

U.S. PATENT DOCUMENTS

| | | | |
|---|---|---|---|
| 5,691,754 | A | 11/1997 | Ta |
| 6,012,794 | A | 1/2000 | Nakano et al. |

(Continued)

FOREIGN PATENT DOCUMENTS

| | | | |
|---|---|---|---|
| CN | 1313195 | A | 9/2001 |
| EP | 1038680 | A2 | 9/2000 |

(Continued)

OTHER PUBLICATIONS

European Search Report, European Application No. 09163677, Mailed Oct. 9, 2009.

*Primary Examiner* — Lam Nguyen
(74) *Attorney, Agent, or Firm* — Nutter McClennen & Fish LLP; John J. Penny, Jr.; Derek Roller

(57) ABSTRACT

A fluid discharge device, a printing device, and a control method for a fluid discharge device enable accurately detecting an empty fluid state and suppressing fluid waste. An inkjet printer 1 has an ink cartridge in which ink is stored, a subtank that draws ink from the ink cartridge, an inkjet head to which ink is supplied from the subtank, a movable carriage on which the inkjet head and subtank are mounted, an ink pump unit that draws the ink supplied to the inkjet head from the ink cartridge by movement of the carriage, and a control unit that determines if ink is in the ink cartridge based on the load required to move the carriage.

11 Claims, 21 Drawing Sheets

(56) References Cited

U.S. PATENT DOCUMENTS

| | | | |
|---|---|---|---|
| 6,145,971 | A | 11/2000 | Baker et al. |
| 6,431,694 | B1 | 8/2002 | Ross |
| 6,568,781 | B2 | 5/2003 | Moriyama |
| 2001/0028373 | A1 | 10/2001 | Iwaya et al. |
| 2001/0040610 | A1 | 11/2001 | Kurata et al. |
| 2005/0206698 | A1 | 9/2005 | Aldrich |
| 2005/0285893 | A1 | 12/2005 | Van Gerven |
| 2006/0007254 | A1 | 1/2006 | Tanno et al. |
| 2006/0038862 | A1 | 2/2006 | Tanno |

FOREIGN PATENT DOCUMENTS

| | | | |
|---|---|---|---|
| EP | 2070705 | A1 | 6/2009 |
| JP | 07060988 | A | 3/1995 |
| JP | 9254405 | A | 9/1997 |
| JP | 11010909 | A | 1/1999 |
| JP | 2001071530 | A | 3/2001 |
| JP | 2002137414 | A | 5/2002 |
| JP | 2007-105935 | A | 4/2007 |
| JP | 2007160639 | A | 6/2007 |

FLUID DISCHARGE DEVICE AND METHOD OF CONTROLLING A FLUID DISCHARGE DEVICE

This application is a divisional of U.S. patent application Ser. No. 12/491,591, filed Jun. 25, 2009 now issued as U.S. Pat. No. 8,827,431. Priority is claimed to Japanese Patent Applications No. 2008-167363, filed Jun. 26, 2008, No. 2008-168954, filed Jun. 27, 2008, No. 2008-243151, filed Sep. 22, 2008, and No. 2009-140009, filed Jun. 11, 2009, the disclosures of which, including the specifications, drawings and claims, are incorporated by reference in their entireties.

BACKGROUND OF THE INVENTION

1. Technical Field

The present invention relates to a fluid discharge device that supplies fluid from a main tank through a subtank to a head, to a printing device, and to a method of controlling the fluid discharge device.

2. Description of Related Art

One example of a fluid discharge device is a device that is incorporated in a printer connected to a personal computer, for example, and discharges fluid ink to a print head.

Japanese Unexamined Patent Appl. Pub. JP-A-2001-71530, for example, teaches a fluid discharge device that has a printing control means for controlling a printing means, a maintenance control means, and an ink consumption control means, calculates ink consumption based on cleaning operations and an ink discharge count, and warns the user when it is time to replace the ink.

Japanese Unexamined Patent Appl. Pub. JP-A-2001-71530 estimates the remaining ink quantity by determining ink consumption from an ink discharge count, but the detection is not particularly precise. As a result, the threshold value for determining the ink end must be set higher than the actual ink end level to provide a sufficient margin of error, the ink cartridge is thus replaced with some amount of usable ink remaining, and ink is thus wasted.

SUMMARY OF THE INVENTION

A fluid discharge device, a printing device, and a control method for a fluid discharge device according to the present invention enable accurate detection of an empty fluid state and reduce fluid waste.

A first aspect of the invention is a fluid discharge device having a main tank in which a fluid is stored in a sealed storage unit of variable capacity; a subtank to which fluid is supplied from the main tank; a head to which fluid is supplied from the subtank; a movable carriage on which the head and the subtank are mounted; a refill mechanism that supplies the fluid supplied to the head from the main tank to the subtank by movement of the carriage; and a controller that determines if fluid is in the main tank based on the load required to move the carriage.

In the fluid discharge device according to another aspect of the invention, because the refill mechanism supplies fluid from the main tank to the subtank by movement of the carriage, and the main tank stores the fluid in a sealed storage unit of variable capacity, the load required to move the carriage, which causes the refill mechanism to operate, increases as a result of the remaining fluid volume in the main tank decreasing. Furthermore, because the controller determines the presence of fluid in the main tank based on the load required to move the carriage, the presence of fluid in the main tank can be determined with good precision without providing a separate detection unit. The main tank can therefore be replaced or refilled at an appropriate timing, and fluid waste can be significantly suppressed.

In a fluid discharge device according to another aspect of the invention, the refill mechanism preferably has a chamber that is mounted on the carriage, moves with the carriage, and has a variable capacity; and an expansion unit that causes the chamber to expand and fluid be drawn from the main tank by movement of a movable member that is moved through an elastic member as a result of carriage movement.

With the fluid discharge device according to this aspect of the invention, the controller can determine the presence of fluid from the main tank with good precision in the construction that draws fluid from the main tank based on the load required to move the carriage because the expansion unit causes the chamber to expand as a result of carriage movement.

In a fluid discharge device according to another aspect of the invention the refill mechanism preferably has a fluid chamber that is mounted on the carriage, moves with the carriage, and has a variable capacity; an urging member that causes the fluid chamber to expand; and a compression unit that causes the fluid chamber to contract and fluid be drawn from the main tank by movement of the carriage in resistance to the urging force of the urging member.

In the fluid discharge device according to this aspect of the invention the controller can determine the presence of fluid from the main tank with good precision in the construction that draws fluid from the main tank by movement of the carriage causing compression in resistance to the urging force of the urging member and the ensuing expansion of the urging member drawing fluid from the main tank based on the load required to move the carriage.

Further preferably in a fluid discharge device according to another aspect of the invention the controller determines the presence of fluid in the main tank by comparing an integral of the load required for carriage movement with a preset threshold value.

The fluid discharge device according to this aspect of the invention can determine the presence of fluid in the main tank with good precision by comparing the integral of the load required to move the carriage with a threshold value.

In the fluid discharge device according to another aspect of the invention the controller preferably determines the presence of fluid in the main tank by comparing a load required to move the carriage that has reached a specific position with a preset threshold value.

The fluid discharge device according to this aspect of the invention can determine the presence of fluid in the main tank with good precision by comparing the load required to move the carriage that has reached a specific position with a preset threshold value.

In the fluid discharge device according to another aspect of the invention the controller preferably determines the presence of fluid in the main tank by comparing the position of the carriage to which a rated load is applied with a preset reference position.

The fluid discharge device according to this aspect of the invention can determine the presence of fluid in the main tank with good precision by comparing the position of the carriage to which a rated load is applied with a preset reference position.

In the fluid discharge device according to another aspect of the invention the controller preferably determines the presence of fluid in the main tank by comparing the load required to move the carriage during a first carriage movement and the load required to move the carriage during a second carriage movement.

The fluid discharge device according to this aspect of the invention can determine the presence of fluid in the main tank with good precision by comparing the load required to move the carriage during a first carriage movement and the load required to move the carriage during a second carriage movement.

In the fluid discharge device according to another aspect of the invention the controller preferably determines the presence of fluid in the main tank by comparing the load required to move the carriage in a fluid refill load area where the fluid refill operation can occur and a normal load area where the fluid refill operation does not occur when the carriage is moved after the fluid refill operation by the refill mechanism.

Because the load required to move the carriage in the fluid refill load area and the normal load area does not change in the movement of the carriage after the fluid refill operation if fluid can be supplied from the main tank, the presence of fluid in the main tank can be determined with good precision by comparing the load required to move the carriage in the fluid refill load area and the normal load area after the fluid refill operation. Furthermore, because the comparison data is acquired at substantially the same time, the result is not affected by carriage load changes caused by durability and the reliability of the comparison can be improved.

In the fluid discharge device according to another aspect of the invention the controller preferably determines the presence of fluid in the main tank by comparing the integrals of the loads required to move the carriage an equal distance in the fluid refill load area and the normal load area.

The fluid discharge device according to this aspect of the invention can determine the presence of fluid in the main tank with good precision by comparing the integrals of the loads required to move the carriage an equal distance in the fluid refill load area and the normal load area.

In the fluid discharge device according to another aspect of the invention the controller preferably determines the presence of fluid in the main tank by comparing the averages of the loads required to move the carriage in the fluid refill load area and the normal load area.

The fluid discharge device according to this aspect of the invention can determine the presence of fluid in the main tank with good precision by comparing the averages of the loads required to move the carriage in the fluid refill load area and the normal load area. The distance the carriage moves that is set as the normal load area can also be set more freely. The reliability of the average carriage load in the normal load area can also be improved by increasing the length of carriage movement used as the normal load area, and the time needed to calculate the average carriage load can be shortened by shortening the length of carriage movement used as the normal load area.

In the fluid discharge device according to another aspect of the invention the controller preferably sets the normal load area at a position separated from the fluid refill load area.

Because the fluid discharge device according to this aspect of the invention sets the normal load area at a position separated from the fluid refill load area, if deformation of a component in the refill mechanism, for example, causes the fluid refill position to change and thus changes the point where the fluid refill operation starts, the effect of this change on the calculation of the carriage load in the normal load area can be suppressed, and the reliability of detecting an empty main tank can be improved.

A fluid discharge device according to another aspect of the invention has a main tank in which a fluid is stored in a sealed storage unit of variable capacity; a subtank to which fluid is supplied from the main tank; a head to which fluid is supplied from the subtank; a movable carriage on which the head and the subtank are mounted; a refill mechanism that supplies the fluid supplied to the head from the main tank to the subtank by movement of the carriage; a read/write unit that reads and writes an amount of fluid in the main tank to a storage unit disposed to the main tank; and a controller that when variation in the load required to move the carriage is determined to be abnormal executes an abnormal load evaluation process that determines there is no fluid in the main tank when the remaining fluid amount stored in the storage unit is less than a fluid threshold value, and determines there is a carriage movement error when the remaining fluid amount stored in the storage unit is greater than or equal to the fluid threshold value.

When the variation in the load required to move the carriage is determined to be abnormal, the fluid discharge device according to this aspect of the invention executes an abnormal load evaluation process that determines there is no fluid in the main tank when the remaining fluid amount stored in the storage unit is less than a fluid threshold value, and determines there is a carriage movement error when the remaining fluid amount stored in the storage unit is greater than or equal to the fluid threshold value. The presence of fluid in the main tank and carriage movement problems can therefore be determined with good precision without providing a separate detection unit. The main tank can therefore be replaced or refilled at an appropriate timing, and problems moving the carriage can be resolved quickly.

Furthermore, if the main tank is removed before being depleted and a partially used main tank is then reloaded, the presence of fluid can be reliably detected, and the cost and size can be reduced because a separate sensor or other detector for detecting carriage movement problems is not needed.

A fluid discharge device according to another aspect of the invention also has a position detection unit that detects the position of the carriage. The controller executes the abnormal load determination process when the position of the carriage is the fluid refill position of the refill mechanism based on the detection result from the position detection unit, and determines there is a carriage movement error when the position of the carriage is other than the fluid refill position of the refill mechanism.

The fluid discharge device according to this aspect of the invention can appropriately determine problems moving the carriage and whether there is fluid in the main tank according to the position of the carriage.

In a fluid discharge device according to another aspect of the invention the controller preferably executes a regular fluid presence determination process that determines there is no fluid in the main tank when the variation in the load required for carriage movement is abnormal and the remaining fluid amount stored in the storage unit is less than the fluid threshold value from when the remaining fluid amount stored in the storage unit becomes less than a specific value that is the fluid volume required for a fluid discharge process by the head or a cleaning process that vacuums fluid from the head.

The fluid discharge device according to this aspect of the invention can eliminate the process of determining if fluid is in the main tank when more than enough fluid than is required for the discharge process or the cleaning process remains in the main tank, and control and processing can therefore be simplified.

In the fluid discharge device according to another aspect of the invention the control unit preferably executes the regular fluid presence determination process directly after the discharge process or the cleaning process.

The fluid discharge device according to this aspect of the invention can significantly reduce determination errors caused by differences in the actual remaining fluid amount and the remaining fluid amount that is stored in the storage unit, and enable the regular fluid presence determination process to return an accurate result.

Another aspect of the invention is a fluid supply device that has a main tank in which a fluid is stored in a sealed storage unit of variable capacity; a subtank having a variable capacity fluid chamber to which fluid is supplied from the main tank; a head that discharges fluid supplied thereto from the subtank; a bidirectionally movable carriage on which the head and the subtank are mounted; a carriage motor that moves the carriage bidirectionally; a refill mechanism that supplies the fluid supplied to the head from the main tank to the subtank by movement of the carriage causing movement of an engaging part that can move so that the volume of the chamber disposed in the subtank expands; a read/write unit that reads and writes an amount of fluid in the main tank to a storage unit disposed to the main tank; and a controller that executes an abnormal load evaluation process that determines there is an abnormal load when increase in the carriage motor current is great or said current is greater than or equal to a specific value, and if an abnormal load occurs determines there is no fluid in the main tank when the remaining fluid amount stored in the storage unit is less than a fluid threshold value, and determines there is a carriage movement error when the remaining fluid amount stored in the storage unit is greater than or equal to a fluid threshold value.

If an abnormal load is detected in the carriage motor current, the fluid discharge device according to this aspect of the invention determines that there is no fluid in the main tank when the remaining fluid amount stored in the storage unit is less than a fluid threshold value, and determines there is a carriage movement problem when the remaining fluid amount stored in the storage unit is greater than or equal to a fluid threshold value, and can therefore easily determine which factor caused an abnormal carriage motor current.

Other objects and attainments together with a fuller understanding of the invention will become apparent and appreciated by referring to the following description and claims taken in conjunction with the accompanying drawings.

DESCRIPTION OF PREFERRED EMBODIMENTS

Preferred embodiments of a fluid discharge device and a control method for a fluid discharge device according to the present invention are described below with reference to the accompanying figures.

First Embodiment

FIGS. 1-10 describe an inkjet printer having an ink supply mechanism as an example of a fluid discharge device according to a first embodiment of the invention.

First, the construction of an inkjet printer described as a printing device according to the invention is described.

Figure 1:
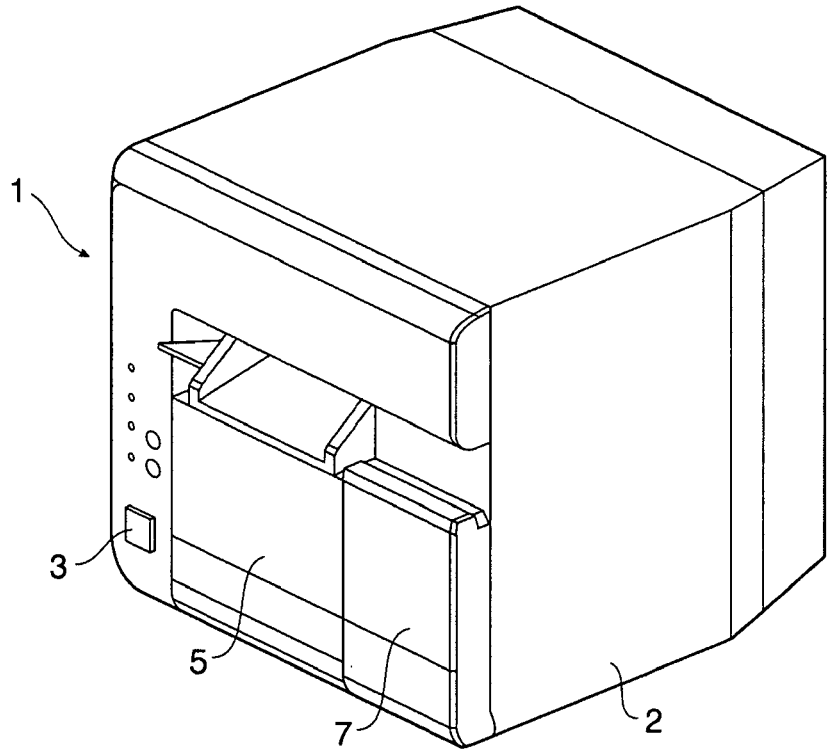
FIG. 1 is an oblique view of an inkjet printer as an example of a printing device according to a first embodiment of the present invention.

As shown in FIG. 1, the inkjet printer 1 uses a plurality of different colors of ink to print in color on a part of the paper delivered from a roll of paper, and has a roll paper cover 5 and an ink cartridge cover 7 disposed to open and close freely at the front of the printer case 2 that covers the printer. A power switch 3, paper feed switch, and indicators are also disposed to the front of the printer case 2.

Figure 2:
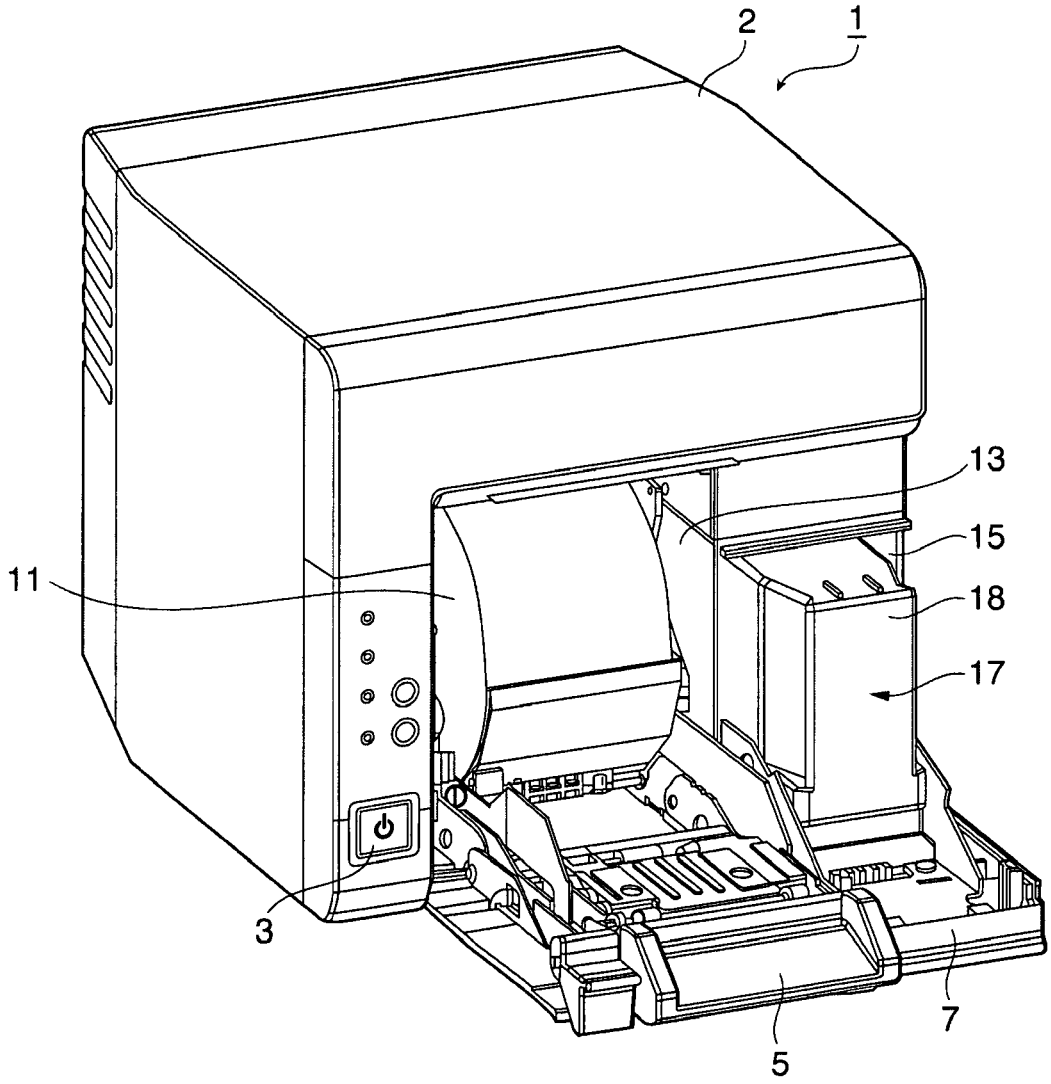
FIG. 2 is an oblique view of the inkjet printer with the printer cover open.

Opening the roll paper cover 5 opens the paper compartment 13 in which the roll paper 11 used as the print medium is stored, as shown in FIG. 2, so that the roll paper 11 can be replaced.

Opening the ink cartridge cover 7 opens the cartridge loading unit 15, enabling installing and removing the ink cartridge 17 (main tank) in the cartridge loading unit 15.

In this embodiment of the invention opening the ink cartridge cover 7 also causes the ink cartridge 17 to be pulled a specific distance forward in front of the cartridge loading unit 15.

Figure 3:
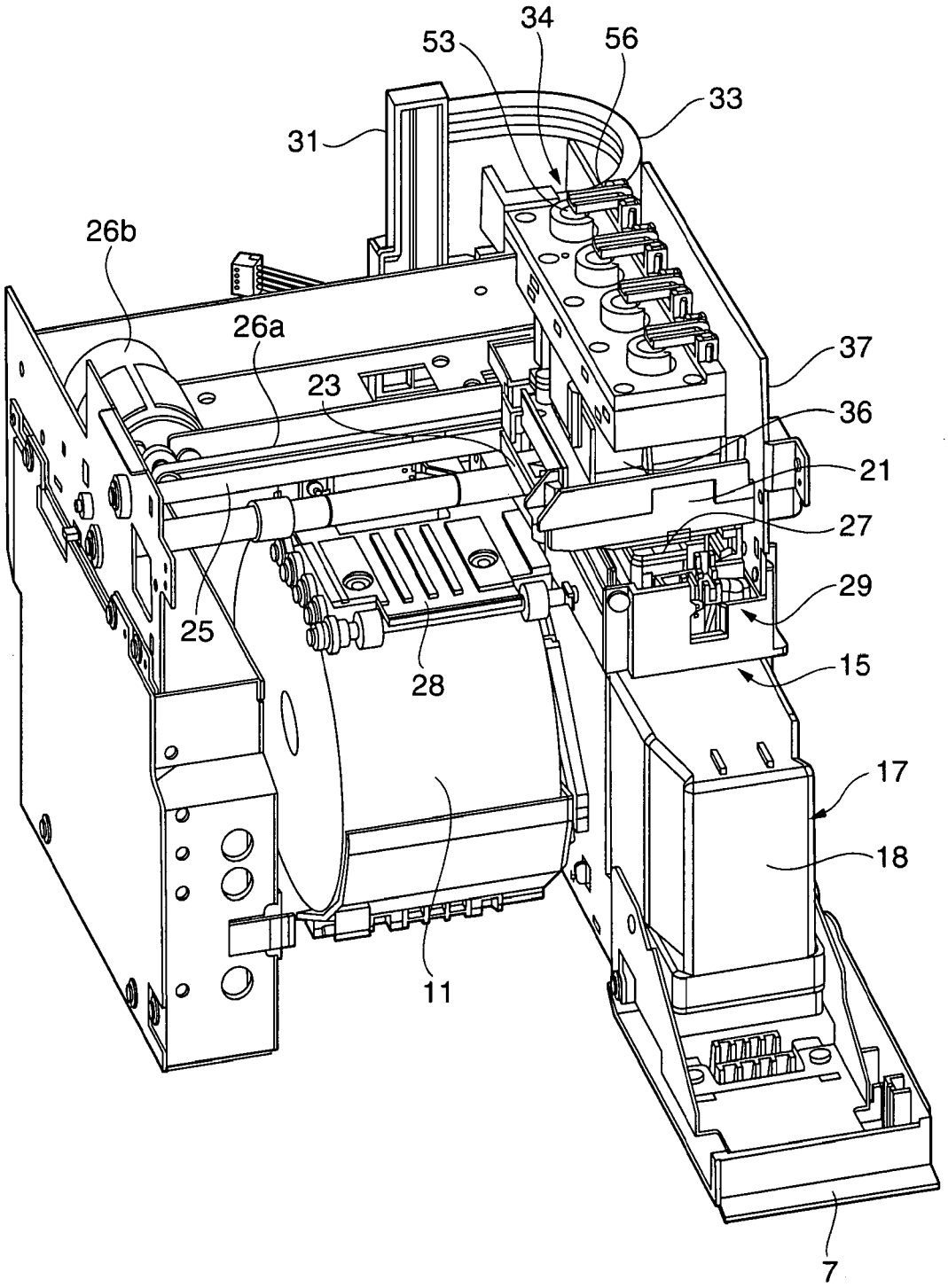
FIG. 3 is an oblique view of the inkjet printer with the printer case removed.
Figure 4:
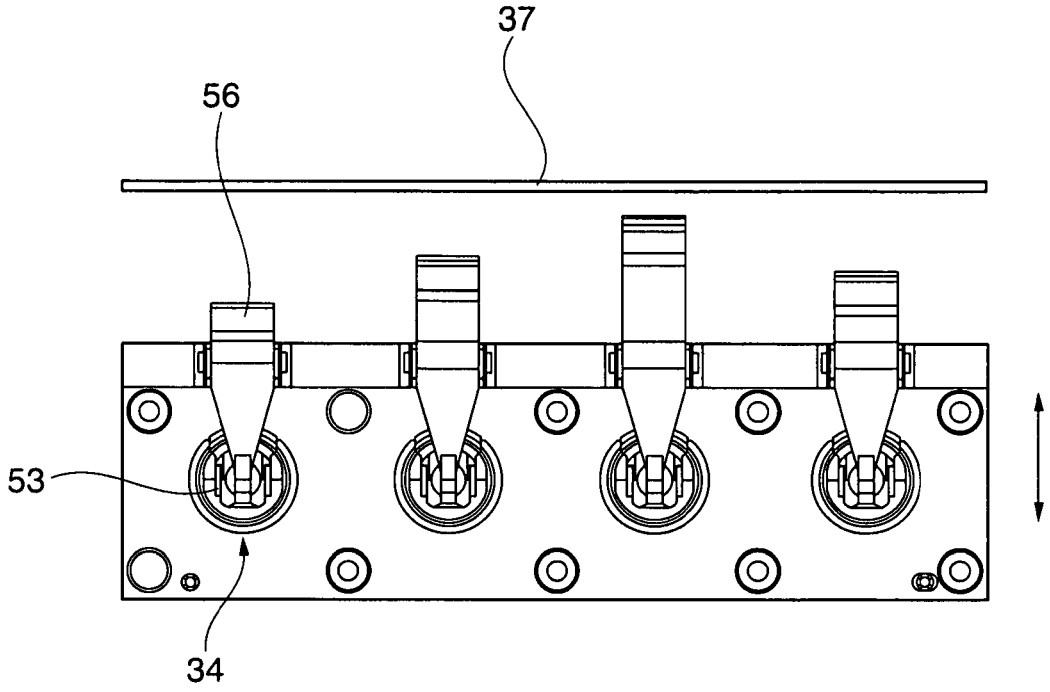
FIG. 4 is a plan view showing the ink pump unit and regulator plate of the inkjet printer.

As shown in FIG. 3, a carriage 23 on which the inkjet head 21 (head) is mounted is disposed above the paper compartment 13 inside the printer case 2. The carriage 23 is supported to move freely widthwise in the printer by a guide member 25 that extends widthwise to the roll paper 11, and can be moved bidirectionally widthwise to the roll paper 11 above the platen 28 by an endless belt **26*a* disposed widthwise to the roll paper 11 and a carriage motor 26***b* that drives the endless belt 26*a*. The inkjet head 21 prints by discharging ink to the part of the roll paper 11 delivered thereto.

As shown in the figure, the standby position (home position) of the bidirectionally moving carriage 23 is above the cartridge loading unit 15. A cap 27 that covers the ink nozzles of the inkjet head 21 exposed below the carriage 23, and an ink vacuum mechanism 29 for vacuuming and disposing of ink inside the ink nozzles of the inkjet head 21 through the cap 27, are disposed below this standby position.

The ink cartridge 17 stores a plurality of color ink packs (not shown) inside the cartridge case 18. Each of the ink packs (storage units) inside the ink cartridge 17 is made of a flexible material and is sealed with ink stored inside. When the ink cartridge 17 is loaded into the cartridge loading unit 15, an ink supply needle (not shown) disposed on the cartridge loading unit 15 side is inserted into and connects with the ink supply opening of the ink pack. The ink path 31 fixed inside the printer case 2 is connected to the ink supply needle of the cartridge loading unit 15, and one end of a flexible ink supply tube 33 having a channel for each color is connected to the ink path 31.

The other end of the ink supply tube 33 is connected to an ink pump unit 34 disposed to the carriage 23 for each color. Each ink pump unit 34 is disposed above the inkjet head 21, and connected to the self-sealing unit 36 connected to the inkjet head 21.

In addition to the inkjet head 21, the ink pump unit 34 and the self-sealing unit 36 are disposed in unison with the carriage 23.

As a result, ink from each ink pack inside the ink cartridge 17 is supplied to the ink nozzles of the inkjet head 21 from the ink supply needle of the cartridge loading unit 15 through the ink path 31, the ink supply tube 33, the ink pump unit 34 for each color, and the self-sealing unit 36 for each color.

The ink pump unit 34 pulls ink from the ink cartridge 17 by moving the carriage 23 relative to the frame of the printer 1, and a regulator panel 37 that causes the ink pump unit 34 to operate by moving the carriage 23 is disposed to the front in the direction of the carriage 23 movement to the standby position.

The ink supply mechanism (fluid supply mechanism) in this inkjet printer 1 includes the ink cartridge 17, the subtank 45, the inkjet head 21, the carriage 23, and the ink pump unit 34.

The ink pump unit 34 of the ink supply mechanism is described below using, by way of example, the structure related to one color.

Figure 5:
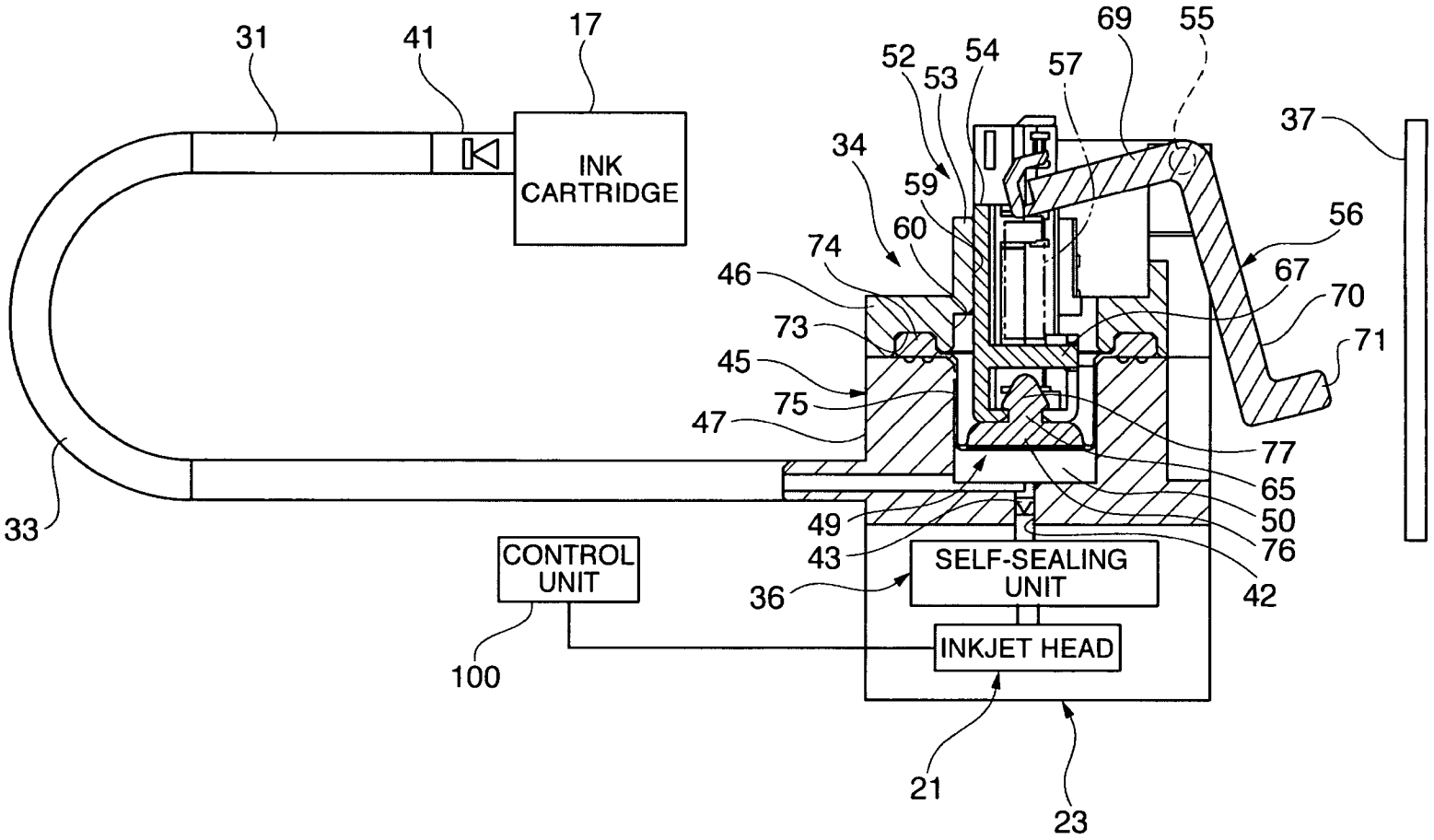
FIG. 5 is a section view showing the main parts of the ink supply mechanism of the inkjet printer.

As shown in FIG. 5, a backflow prevention valve 41 is disposed to one end of the ink path 31 on the ink cartridge 17 side, and the backflow prevention valve 41 prevents ink from flowing between the ink cartridge 17 and the ink pump unit 34 from the ink cartridge 17 side to the ink pump unit 34 side.

The ink pump unit 34 includes a subtank 45 for drawing ink from the ink cartridge 17 through the ink supply tube 33. This subtank 45 has a top part 46 and a bottom part 47, and an ink chamber 50 (fluid chamber) is formed between the top part 46 and bottom part 47 with the top of the ink chamber 50 covered by a flexible membrane 49 that is a flexible diaphragm. The flexible membrane 49 is made of butyl rubber, for example, with low moisture permeability and gas permeability.

The ink chamber 50 communicates with the ink supply tube 33 and with the path 42 on the self-sealing unit 36 side so that ink can be supplied from the ink cartridge 17 and ink can be supplied to the self-sealing unit 36 side. A backflow prevention valve 43 is disposed to the end of the path 42 on the self-sealing unit 36 side, and the backflow prevention valve 43 enables ink to flow between the ink chamber 50 and self-sealing unit 36 from the ink chamber 50 side to the self-sealing unit 36 side.

The flexible membrane 49 is made from an easily deformable flexible material, and the capacity of the ink chamber 50 can change, expanding and contracting, as the flexible membrane 49 deforms. An expansion mechanism 52 (expansion unit) that causes the flexible membrane 49 to displace to expand the ink chamber 50 is disposed to the ink pump unit 34.

The expansion mechanism 52 includes a tubular cylinder 53 that rises vertically, a piston 54 (moving member) that fits slidably vertically inside the cylinder 53, a rocker arm 56 (engaging member) that is supported to rock on a rocker pin 55 above the cylinder 53 in the top part 46, and a coil tension spring 57 (elastic unit) that is interposed between the rocker arm 56 and piston 54.

The cylinder 53 is made from a plastic material such as polypropylene with low moisture permeability and gas permeability. The cylinder 53 has a necked configuration with a small diameter inside surface 59 formed at the top with an inside diameter that is slightly greater than the outside diameter of the piston 54 to slidably guide the outside surface of the piston 54, and a large diameter inside surface 60 formed at the bottom with a space between it and the outside surface of the piston 54.

The piston 54 is made from a plastic material such as polypropylene with low moisture permeability and gas permeability. The piston 54 is substantially cylindrical with a bottom, and has a slot from the top end to the middle on the rocker arm 56 side for positioning the rocker arm 56.

A catch 67 that holds the bottom end of the coil tension spring 57 is formed at a position above the bottom of the piston 54.

The rocker arm 56 has an arm part 69 that extends from the rocker pin 55 inside the cylinder 53, a vertical leg 70 that extends down from the rocker pin 55, and an input part 71 that extends in the opposite direction as the arm part 69 from the opposite end of the vertical leg 70 as the arm part 69. The distal end of the arm part 69 is hook shaped, and holds the top end of the coil tension spring 57.

The flexible membrane 49 is an integral molding having an annular thick-wall base part 74 that is disposed between the top part 46 and bottom part 47 fit into an annular groove 73 in the top part 46, a thin-wall membrane part 75 that extends with a cylindrical shape from the inside diameter part of the base part 74, and a thick-walled, substantially disc-shaped fixed part 76 that occludes the opposite side of the membrane part 75 as the base part 74.

A nipple 77 that tapers substantially to a point at the distal end is formed in unison to the middle of the fixed part 76, and this nipple 77 is press-fit into and held by a slit 65 formed in the piston 54. When thus disposed, the fixed part 76 is held in unison with the bottom of the piston 54, and the fixed part 76 and membrane part 75 of the flexible membrane 49 are displaced as the piston 54 moves.

Figure 6:
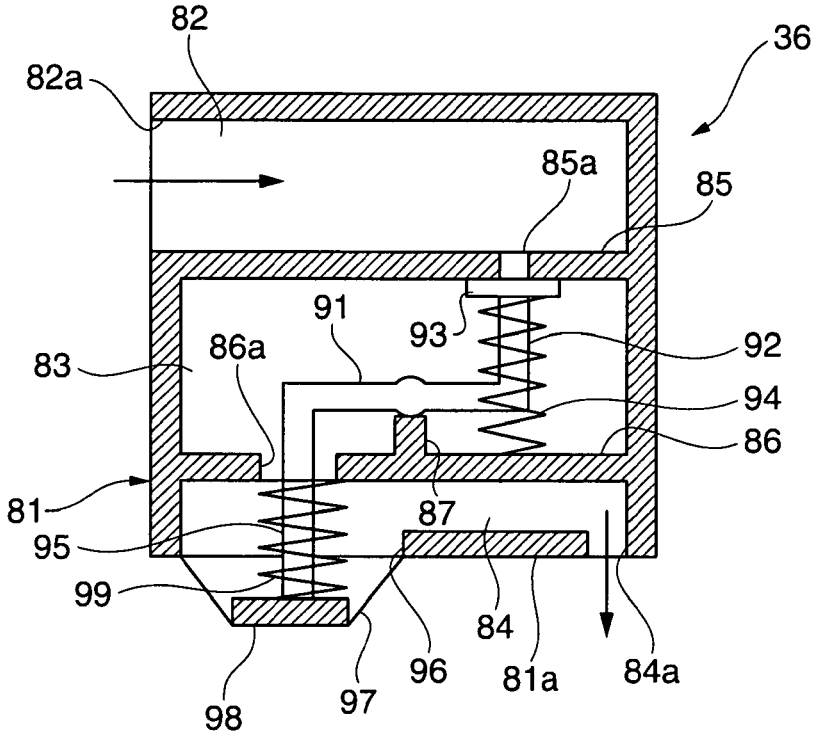
FIG. 6 is a section view showing the structure of the self-sealing unit of the inkjet printer.

As shown in FIG. 6, the self-sealing unit 36 has a supply path 82, a middle path 83, and a discharge path 84 formed in a unit housing 81. The downstream end part of the path 42 is connected to the supply opening 82*a* rendered to the supply path 82, and the inkjet head 21 is connected to the discharge opening 84*a* rendered to the discharge path 84.

A flow opening 85*a* is formed in the divider wall 85 separating the supply path 82 and middle path 83, and ink in the supply path 82 flows through the flow opening 85*a* into the middle path 83. A communication hole 86*a* is formed in the divider wall 86 separating the middle path 83 and discharge path 84, and ink in the middle path 83 flows through this communication hole 86*a* into the discharge path 84.

A support unit 87 is rendered on the divider wall 86 inside the middle path 83, and a rocker arm 91 is pivotably supported on this support unit 87. An operating rod 92 that bends toward the divider wall 85 side is formed in unison to one end of the rocker arm 91, and an occlusion plate 93 that contacts the divider wall 85 and closes the flow opening 85*a* is rendered on the distal end of this operating rod 92. A compression spring 94 is disposed between the occlusion plate 93 and divider wall 86, and the occlusion plate 93 is urged toward the divider wall 85 side by the urging force of this compression spring 94. A pusher rod 95 that is inserted through the communication hole 86*a* in the divider wall 86 is formed bending toward the divider wall 86 side at the other end of the rocker arm 91.

An opening 96 is formed in the side wall 81*a* of the unit housing 81 on the discharge path 84 side. A film 97 that is liquid-tight and flexible is attached with a liquid-tight connection to the lip part of the opening 96. A pressure plate 98 is fixed to the middle part of the film 97 on the discharge path 84 side. The distal end of the pusher rod 95 part of the rocker arm 91 contacts this pressure plate 98.

A compression spring 99 is attached between the pressure plate 98 and the divider wall 86, and the pressure plate 98 is pushed to the outside by the urging force of this compression spring 99. The occlusion plate 93 in this self-sealing unit 36 is thus pressed to the divider wall 85 by the compression spring 94 and the pressure working on the occlusion plate 93, and thus closes the flow opening 85*a*.

When the capacity of the part covered by the film 97 in this self-sealing unit 36 decreases and the pusher rod 95 part of the rocker arm 91 is pushed by the pressure plate 98, the rocker arm 91 rocks at the point where it is supported on the support unit 87, and the occlusion plate 93 separates from the divider wall 85. Ink thus flows from the supply path 82 through the flow opening 85*a* into the middle path 83 and discharge path 84, and is supplied to the inkjet head 21.

By disposing this self-sealing unit 36 on the upstream side of the inkjet head 21, variation in the ink pressure on the supply side caused by acceleration or deceleration of the carriage 23, for example, is prevented by the self-sealing unit 36 from being transmitted to the inkjet head 21.

As a result, problems caused by transmission of such pressure variation, including unintended discharge of ink from the inkjet head 21, ink smears, and missing dots caused by defective discharge, are prevented.

When the carriage 23 is in the standby position in the inkjet printer 1 configured as described above, the input part 71 of the rocker arm 56 contacts the regulator panel 37 of the carriage 23, the vertical leg 70 is vertical, and the arm part 69 and input part 71 are horizontal. The urging force of the coil tension spring 57 at this time pulls the piston 54 up.

When the carriage 23 leaves the standby position and is moved to the printing area of the inkjet head 21, and ink is then discharged from the inkjet head 21 in the printing area to print, ink is supplied from the self-sealing unit 36 to the inkjet head 21, the inside of the self-sealing unit 36 goes to negative pressure, and ink is supplied from the ink chamber 50 through the path 42 to the self-sealing unit 36.

When the amount of ink in the ink chamber 50 drops, the decrease in ink produces a negative pressure, and the piston 54 and fixed part 76 descend in unison while deforming the membrane part 75 of the flexible membrane 49. As a result, the rocker arm 56 connected through the coil tension spring 57 to the piston 54 rocks and causes the distal end of the arm part 69 to descend, thus causing the amount that the rocker arm 56 protrudes to the input part 71 side to increase.

When the carriage 23 returns to the standby position, the rocker arm 56 that moves with the carriage 23 contacts the regulator panel 37 outside the carriage 23 at the input part 71, the rocker arm 56 therefore rocks as a result of carriage 23 movement, and the input part 71 returns to vertical and the arm part 69 and input part 71 return to horizontal. As a result, the distal end part of the arm part 69 rises, and the piston 54 connected thereto through the coil tension spring 57 slides inside the cylinder 53 and is pulled up.

Movement of the piston 54 through the coil tension spring 57 causes the fixed part 76 of the flexible membrane 49 of the ink pump unit 34 to rise in unison with the piston 54, expanding the ink chamber 50 of the subtank 45 and increasing the capacity. When the capacity of the ink chamber 50 increases, ink is drawn into the ink chamber 50 through the ink path 31 and ink supply tube 33 from the ink cartridge 17 while the backflow prevention valve 41 opens and the backflow prevention valve 43 closes.

The control unit 100 of the inkjet printer 1 configured as described above executes the above ink supply operation at a specific timing during the printing operation. Note that this ink supply operation is executed as long as there is at least enough ink left in the ink chamber 50 to enable supplying ink to the inkjet head 21 even if printing consumes the maximum amount of ink.

Figure 7:
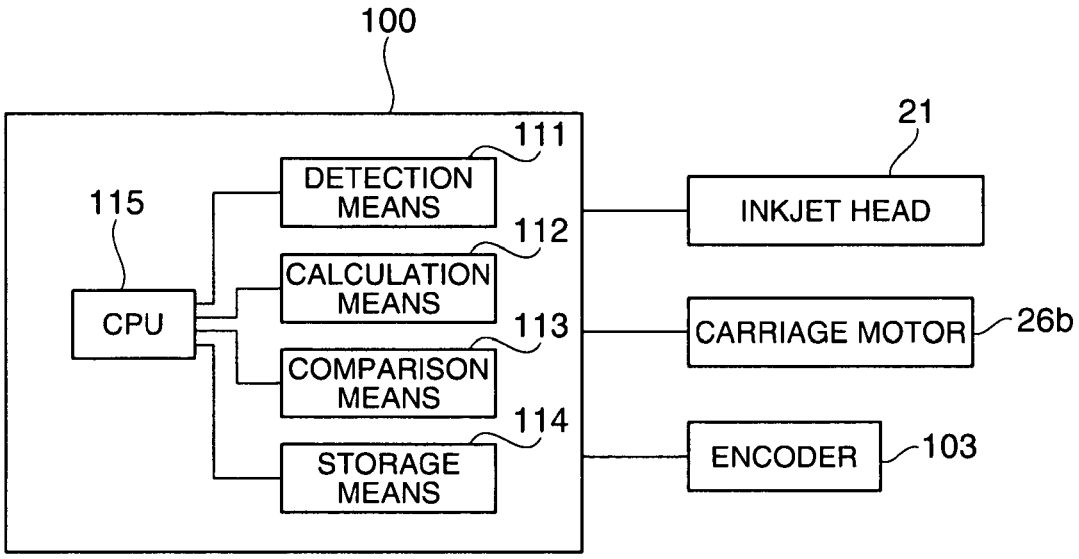
FIG. 7 is a block diagram describing the control system of the inkjet printer.

As shown in FIG. 7, the control unit 100 (controller) of the inkjet printer 1 drives the inkjet head 21 and carriage motor 26*b* by sending control signals to the inkjet head 21 and carriage motor 26*b*, and controls the roll paper 11 printing process, for example. An encoder 103 that sends carriage 23 position information is also connected to the control unit 100, and the control unit 100 detects the position of the carriage 23 based on the signal from the encoder 103.

The control unit 100 has a detection unit 111, calculation unit 112, comparison unit 113, storage unit 114 and CPU 115, and the detection unit 111, calculation unit 112, and comparison unit 113 are controlled by the CPU 115.

The detection unit 111 detects the carriage motor 26*b* current. Based on the current detected by the detection unit 111, the calculation unit 112 calculates and integrates the carriage load, which is the load required to move the carriage 23, as a current value. The comparison unit 113 compares a threshold value previously stored in the storage unit 114 with the integral of the carriage load derived from the current by the calculation unit 112. Based on the result of the comparison from the comparison unit 113, the CPU 115 evaluates the ink empty status of the ink cartridge 17.

Because the ink packs in the ink cartridge 17 are made of a flexible material and have a changeable capacity, and are sealed with ink stored inside, when the remaining ink level inside decreases and the ink pack goes to a near-empty state, the load required to expand the ink chamber 50 and draw in ink increases. This is described with reference to FIG. 8.

Figure 8:
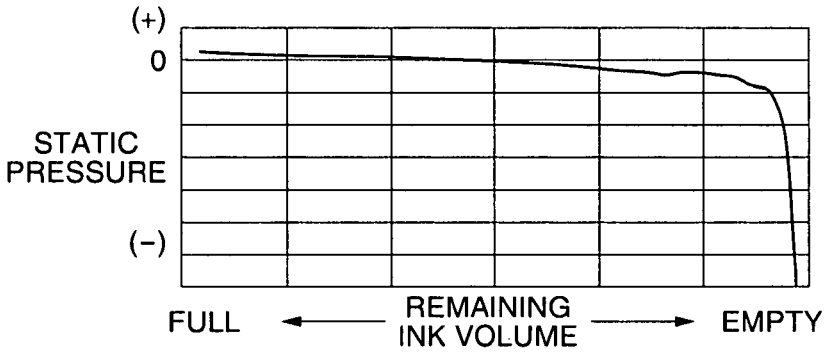
FIG. 8 is a graph showing the relationship between the remaining ink level and the internal pressure of the ink cartridge.

The y-axis in FIG. 8 shows the static pressure inside the ink cartridge 17, and the x-axis shows the remaining ink level. The static pressure is positive when the ink cartridge 17 is full, but decreases gradually as ink is consumed. When the remaining ink level becomes low, the static pressure goes negative because the flexible ink pack deforms, and then drops sharply when the ink level goes to nearly empty.

Therefore, when ink is drawn from the ink cartridge 17 into the ink chamber 50, the carriage motor 26*b* current is low when the ink cartridge 17 is full of ink, and the carriage motor 26*b* current increases as the remaining ink level in the ink cartridge 17 decreases. When the ink in the ink cartridge 17 is depleted, the carriage motor 26*b* current rises because the piston 54 does not move and only the coil tension spring 57 is extended.

More specifically, because the load of moving the carriage 23 to expand the ink chamber 50 increases and the carriage motor 26*b* current increases greatly when the ink cartridge 17 is empty and there is no ink, the threshold value stored in the storage unit 114 is set based on the current when there is no ink.

The control unit 100 configured as described above detects when there is no ink in the ink cartridge 17 and the ink cartridge 17 is empty, and notifies the user that it is time to replace the ink cartridge 17.

Figure 9:
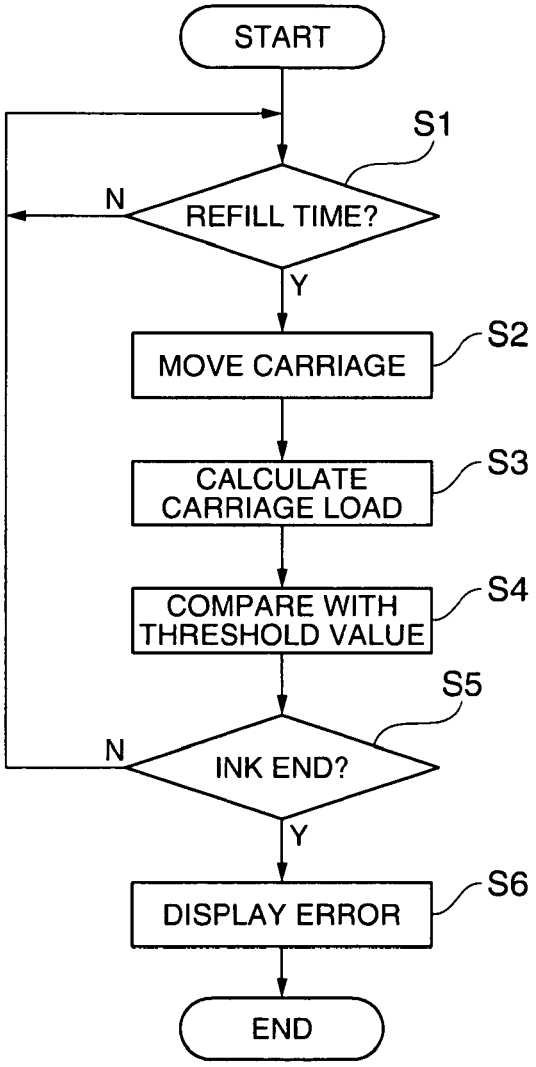
FIG. 9 is a flow chart describing empty ink cartridge detection control by the control unit.
Figure 10:
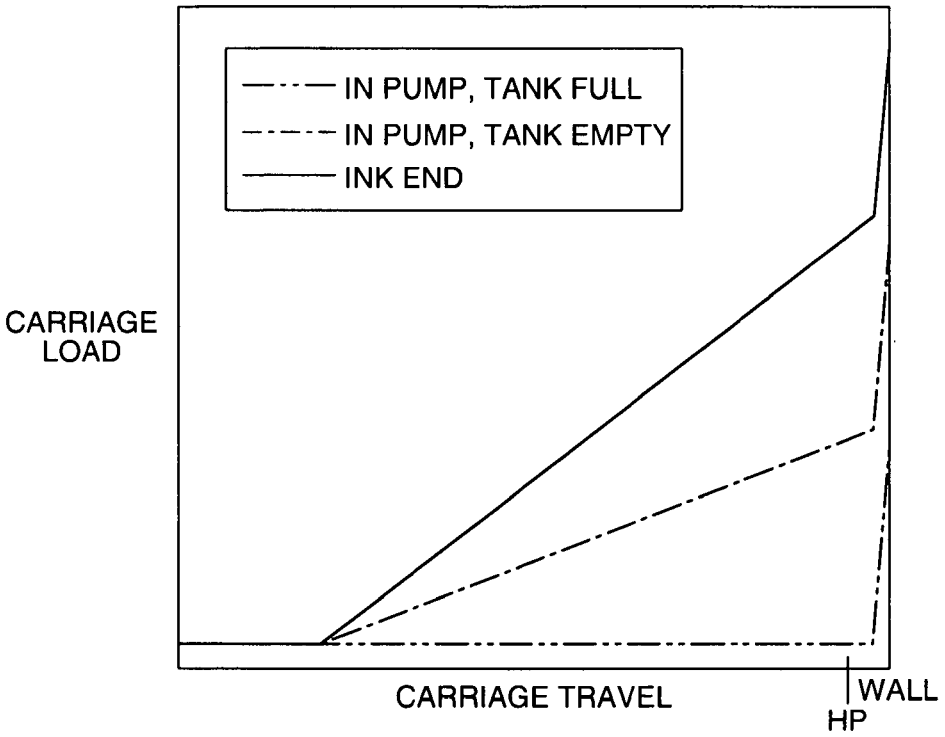
FIG. 10 is a graph showing the relationship between carriage movement and carriage load.

An empty ink cartridge detection control by the control unit 100 for detecting when the ink cartridge 17 becomes empty is described below with reference to the flowchart in FIG. 9 and the graph in FIG. 10 showing the relationship between carriage movement and carriage load.

The ink refill operation starts at the ink refill timing (step S1 returns Yes), and the carriage 23 moves to the standby position (step S2).

The control unit 100 thus monitors the carriage load, which is the load required to move the carriage 23, from the carriage motor 26*b* current, the carriage motor 26*b* being a DC motor, integrates the carriage load for the carriage 23 movement (step S3), and compares the integral of this carriage load with the preset threshold value (step S4).

If the integral of this carriage load reaches the preset threshold value, the ink cartridge 17 is determined to be empty (ink end) (step S5 returns Yes).

When the ink cartridge 17 is determined to be empty, the control unit 100 displays an error (step S6) to prompt a replacement of the ink cartridge 17 using the indicators on the front of the printer case 2, for example.

As shown in FIG. 10, when the ink in the ink chamber 50 has not been consumed and the tank is full, the carriage load is constant to the home position (HP), that is, the standby position (denoted by the double-dot dash line in FIG. 10).

When ink has been consumed from the ink chamber 50, the carriage load increases from when the input part 71 of the rocker arm 56 contacts the regulator panel 37 due to ink in the ink cartridge 17 being drawn into the ink chamber 50 and the ink volume increasing as denoted by the dot-dash line in FIG. 10.

If the ink cartridge 17 is depleted of ink, ink will not be drawn into the ink chamber 50. The coil tension spring 57 therefore expands from when the input part 71 of the rocker arm 56 contacts the regulator panel 37 in this condition, and the carriage load increases greatly according to the force of the spring (denoted by the solid line in FIG. 10).

That is, the carriage load differs greatly when the ink cartridge 17 is depleted of ink and when ink remains. It is therefore possible to quickly and easily determine if the ink cartridge 17 is empty (ink end) by comparing the integral of the carriage load required to move the carriage 23 with the threshold value.

If the carriage 23 moves passed the home position (HP), reaches the end, and further movement is stopped, the carriage load rises suddenly as shown in FIG. 10 in each of these patterns. The origin of the carriage 23 can be set by detecting the point of this sudden increase in the carriage load.

As described above, this first embodiment of the invention can determine the presence of ink in the ink cartridge 17 with a high degree of accuracy without providing a separate detection unit because the control unit 100 evaluates the presence of ink in the ink cartridge 17 based on the load required to move the carriage 23 in a configuration that draws ink from the ink cartridge 17 by the expansion mechanism 52 expanding the ink chamber 50 using the force of carriage 23 movement. As a result, the ink cartridge 17 can be replaced or the ink can be replenished at an appropriate time, and ink waste can be greatly reduced.

More particularly, the presence of ink in the ink cartridge 17 can be highly accurately determined by comparing the integral of the carriage load with a threshold value. The IC chip 102 (described below) of the ink cartridge 17 normally uses a safety margin to prevent total depletion of ink under any conditions. In many cases a "no ink" determination is returned even though this margin of ink remains in the ink cartridge, and this marginal amount of ink is thus wasted, but there is substantially no wasted ink with the present invention.

Note that when the integral of the carriage load reaches the preset threshold value in the embodiment described above, the ink cartridge 17 is determined to be empty (ink end), but the method of evaluation is not limited to the integral of the carriage load.

Whether the carriage load when the carriage 23 reaches a specific position is greater than or equal to a specific threshold value may be used for evaluation, for example. The presence of ink in the ink cartridge 17 can be determined with great accuracy in this case by comparing the load required to the move the carriage 23 at this specific position with a threshold value.

Note that this specific position can be set as a position determined by two conditions, the stop of modulation of encoder pulses for detecting the position of the carriage 23, and an increase in the carriage load to the threshold value or above.

Note that it may also be determined from the position of the carriage 23 when the carriage load reaches a specific value. By comparing the position of the carriage 23 where the carriage load reaches the specific value with a preset reference position, the presence of ink in the ink cartridge 17 can be determined with a high degree of accuracy.

Note, also, that this determination can be based on modulation of the encoder pulse for detecting the carriage 23 position.

Figure 11:
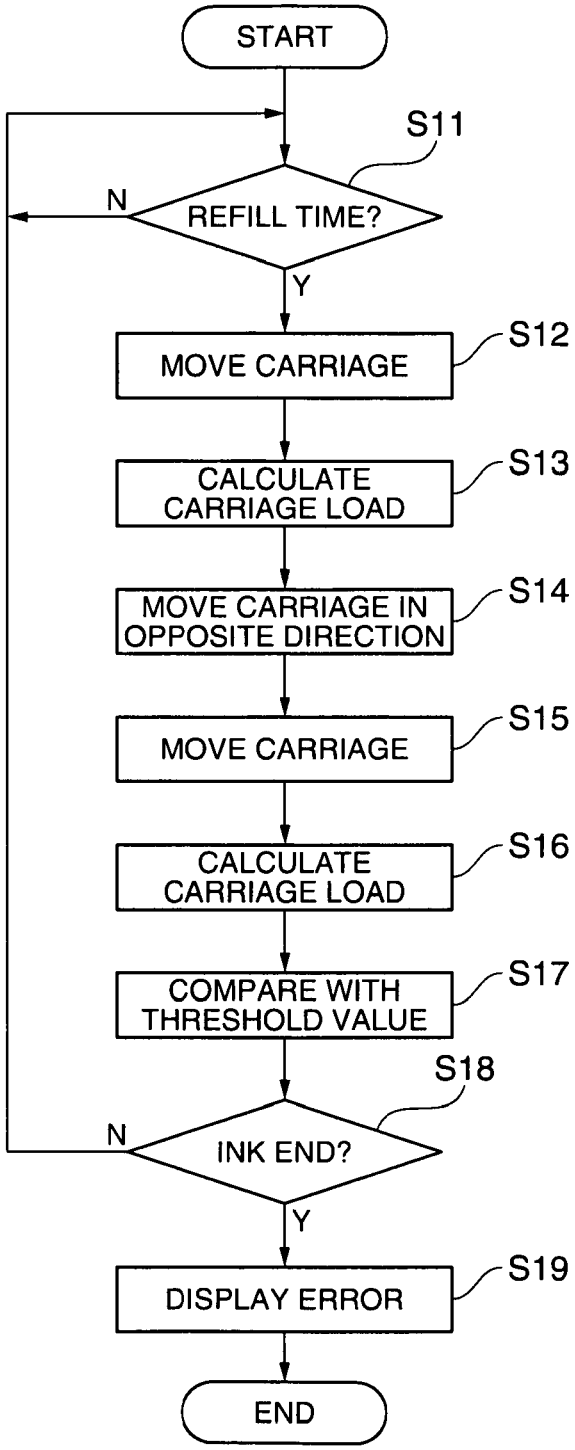
FIG. 11 is a flow chart describing another example of empty ink cartridge detection control by the control unit.

A variation of empty ink cartridge 17 detection control by the control unit 100 in this embodiment of the invention is described next with respect to FIGS. 11-13.

Variation 1

When the ink refill timing is reached (step S11 returns Yes), the ink refill operation starts and the carriage 23 moves toward the standby position (step S12).

The control unit 100 thus monitors the carriage load from the carriage motor 26*b* current, the carriage motor 26*b* being a DC motor, and integrates the carriage load for the carriage 23 movement (step S13).

The control unit 100 then moves the carriage 23 to the printing area side (step S14), and then back toward the standby position (step S15).

The control unit 100 then integrates the carriage load for the carriage 23 movement (step S16).

The control unit 100 then compares the integrals of the carriage load when moving the carriage 23 to the standby position the first and second times (step S17), and determines that the ink cartridge 17 is empty (ink end) if the difference between the integrals is less than a specific threshold value (step S18 returns Yes).

If the ink cartridge 17 is determined to be empty, the control unit 100 displays an error prompting ink cartridge 17 replacement using the indicators on the front of the printer case 2, for example (step S19).

Figure 12B:
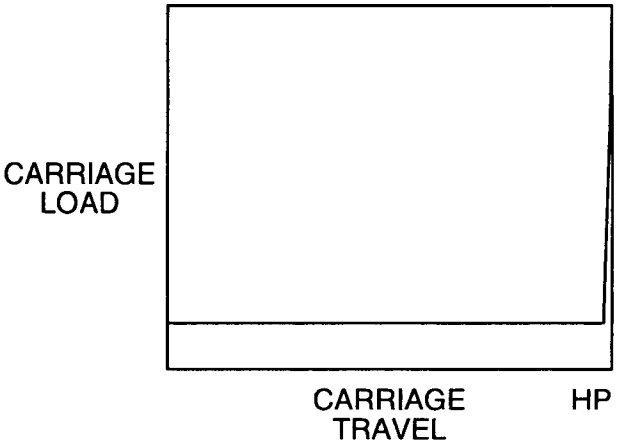
FIG. 12 is a graph showing the relationship between carriage movement and carriage load.
Figure 12A:
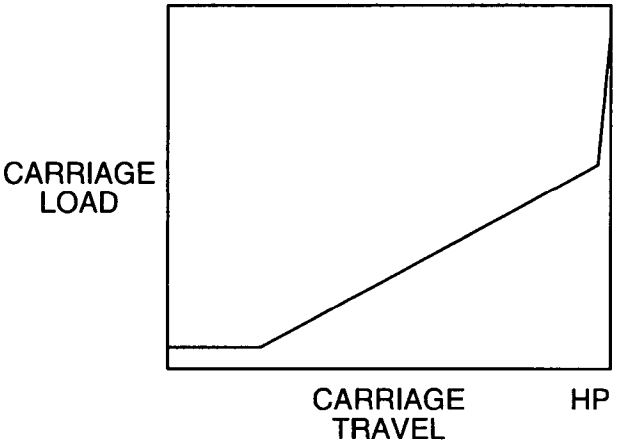

When ink has been consumed from the ink chamber 50, the first time the carriage 23 moves the carriage load increases from when the input part 71 of the rocker arm 56 contacts the regulator panel 37 due to ink in the ink cartridge 17 being drawn into the ink chamber 50 and the volume increasing (see FIG. 12A).

When the carriage 23 is then moved continuously from this position, ink has not been consumed from inside the ink chamber 50 and the ink chamber 50 is full, and the carriage load is constant to the home position (HP), that is, the standby position (see FIG. 12B).

The integrals of the carriage load will therefore differ greatly between the first and second times the carriage 23 moves, and the difference of the carriage load integrals increases.

Figure 13B:
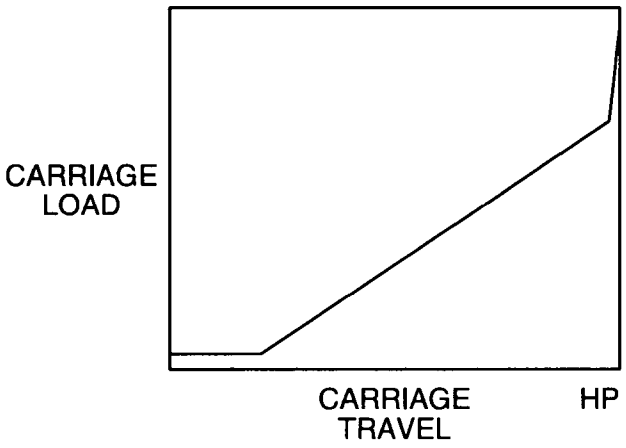
FIG. 13 is a graph showing the relationship between carriage movement and carriage load.
Figure 13A:
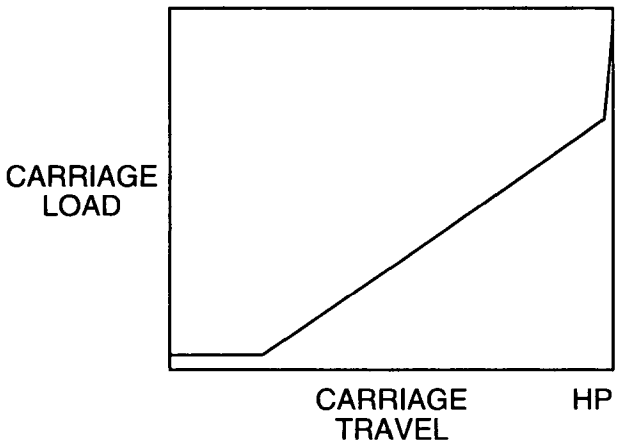

However, if the ink cartridge 17 is empty, ink is not drawn into the ink chamber 50 the first time the carriage 23 moves, the coil tension spring 57 expands from when the input part 71 of the rocker arm 56 contacts the regulator panel 37, and the carriage load increases greatly according to the force of the spring (see FIG. 13A).

When the carriage 23 moves from this position in the second movement of the carriage 23, ink is again not drawn into the ink chamber 50 in the same as was during the first movement, the coil tension spring 57 expands from when the input part 71 of the rocker arm 56 contacts the regulator panel 37, and the carriage load increases greatly according to the force of the spring (see FIG. 13B).

The integrals of the carriage load the first and second times the carriage 23 moves are therefore substantially the same, and the difference of the carriage load integrals is substantially zero.

The difference in the carriage load the first and second times the carriage 23 moves thus differs greatly between when the ink cartridge 17 is empty of ink and when ink remains.

Therefore, whether the ink cartridge 17 is empty (ink end) or not can be easily and quickly determined based on the difference of the first and second carriage load integrals of carriage 23 movement.

In other words, by comparing the integral for the first time the carriage 23 moves and the integral for the second time the carriage 23 moves, the presence of ink in the ink cartridge 17 can be determined with high accuracy.

Figure 14:
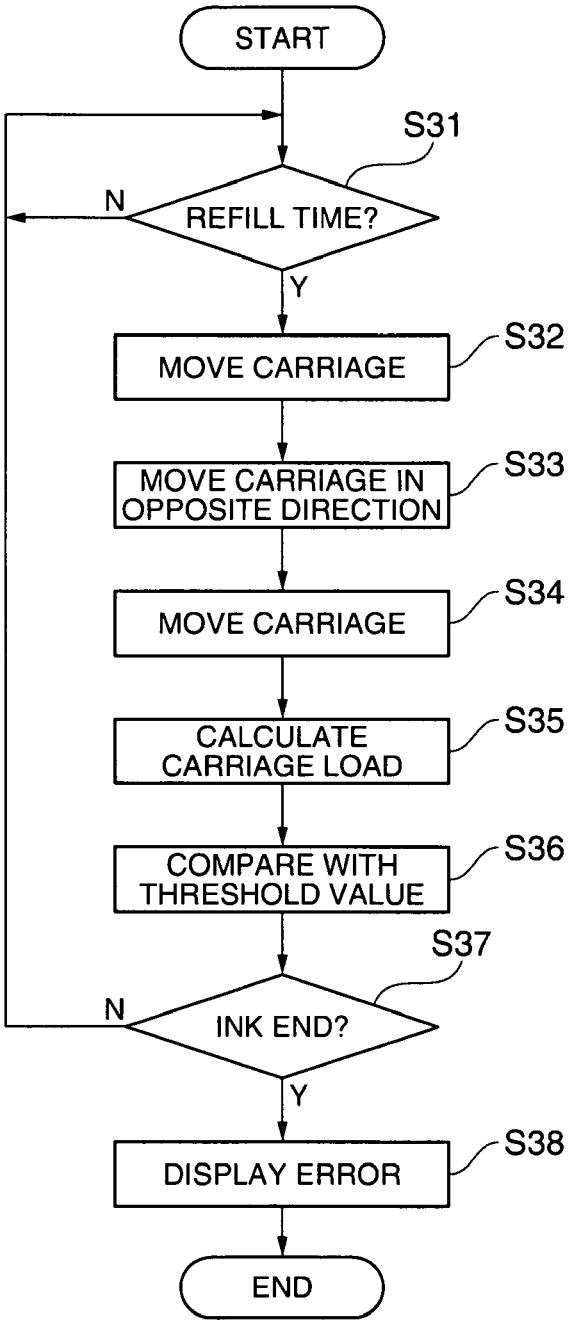
FIG. 14 is a flow chart describing a second variation of empty ink cartridge detection control by the control unit.
Figure 15:
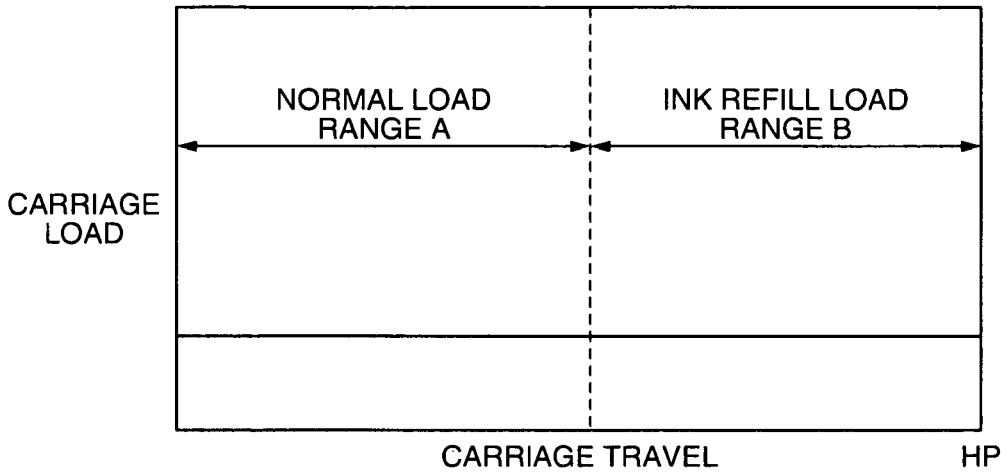
FIG. 15 is a graph showing the relationship between carriage movement and carriage load.
Figure 16:
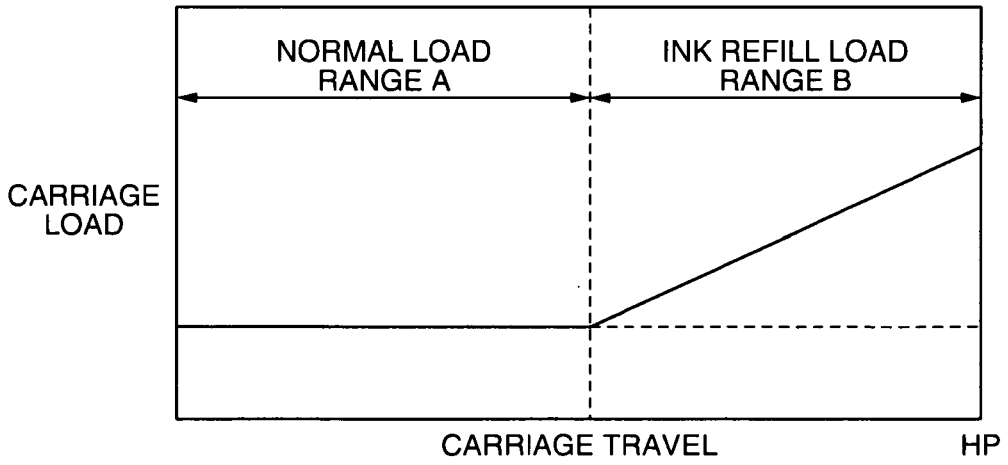
FIG. 16 is a graph showing the relationship between carriage movement and carriage load.

A second variation of empty ink cartridge detection control in this embodiment of the invention is described next with respect to FIGS. 14-16.

Variation 2

When the ink refill timing is reached (step S31 returns Yes), the ink refill operation starts and the carriage 23 moves toward the standby position (step S32).

The control unit 100 then moves the carriage 23 to the printing area side (step S33), and then back toward the standby position (step S34).

The control unit 100 then calculates the carriage load for the carriage 23 movement (step S35).

The control unit 100 then calculates the difference between the carriage load when the carriage 23 moves to a normal load area A where the ink refill operation is not executed, and to an ink refill load area B where the ink refill operation may occur as a result of carriage 23 movement, and compares the difference of these carriage load integrals and a preset threshold value (step S36).

If the difference between the integrals reaches a specific threshold value, the ink cartridge 17 is determined to be empty (ink end) (step S37 returns Yes).

If the ink cartridge 17 is determined to be empty, the control unit 100 displays an error to prompt an ink cartridge 17 replacement using the indicators on the front of the printer case 2, for example (step S38).

The ink refill load area B is the area from the position where the input part 71 contacts the regulator panel 37 to the standby position (HP) when the ink chamber 50 of the subtank 45 is empty, the input part 71 of the rocker arm 56 is maximally protruding, and the carriage 23 moves in the standby position direction.

The normal load area A is an area of carriage 23 movement that is equal in length to the ink refill load area B and is outside the ink refill load area B, and in this embodiment of the invention the printing area side adjacent to the ink refill load area B is set as the normal load area A.

As described above, when the carriage 23 moves to the standby position again after the ink refill operation, the input part 71 of the rocker arm 56 is not protruding when the ink chamber 50 of the subtank 45 has been filled by the ink refill operation. As a result, the carriage load is constant in the normal load area A and the ink refill load area B, and there is no difference in the carriage load integrals in these areas.

However, when the ink cartridge 17 becomes empty in the ink refill operation and the ink chamber 50 of the subtank 45 is not filled by the ink refill operation, the input part 71 of the rocker arm 56 protrudes. As a result, as shown in FIG. 16, the coil tension spring 57 expands from when the input part 71 of the rocker arm 56 contacts the regulator panel 37 in the ink refill load area B, and the carriage load rises according to the force of the spring. In other words, the carriage load is constant in the normal load area A but rises in the ink refill load area B, and a difference between the integrals results.

In the normal load area A and the ink refill load area B, the difference in the carriage load when the carriage 23 moves toward the standby position after the ink refill operation differs greatly when the ink cartridge 17 is empty of ink and when ink remains.

Whether the ink cartridge 17 is empty (ink end) or not can therefore be easily and quickly determined based on the difference of the integrals of the carriage load in the normal load area A and ink refill load area B.

This second variation determines if the ink cartridge 17 is empty (ink end) based on the difference of the carriage load integrals in the normal load area A and the ink refill load area B, but this determination may also be based on the difference of the average carriage loads in the normal load area A and ink refill load area B. In this case the length of movement in the normal load area A does not need to equal the ink refill load area B, and the length of carriage 23 movement that is set as the normal load area A can be set more freely. The reliability of the average carriage load in the normal load area A can also be improved if the distance moved in the normal load area A is longer, and the time needed to calculate the average carriage load can be shortened if the distance moved in the normal load area A is shorter.

Further preferably, the normal load area A is separated from the ink refill load area B, and the normal load area A and ink refill load area B are disposed to positions separated with a gap therebetween. When thus positioned, if deformation of the rocker arm 56 or coil tension spring 57, for example, in the ink pump unit 34 causes the position to which the input part 71 of the rocker arm 56 protrudes to change and thus changes the point where the ink refill operation starts, the effect of this change on the calculation of the carriage load in the normal load area A can be suppressed, and the reliability of empty ink cartridge 17 detection can be improved.

The ink chamber 50 of the ink pump unit 34 is located inside the subtank 45 in the embodiment described above, but a configuration in which the ink pump unit 34 is disposed to a position on the upstream side of the subtank 45 and on the downstream side of the ink cartridge 17 is also conceivable.

Second Embodiment

A second embodiment of the invention is described next.

This second embodiment is described primarily with reference to the differences to the first embodiment.

Figure 17:
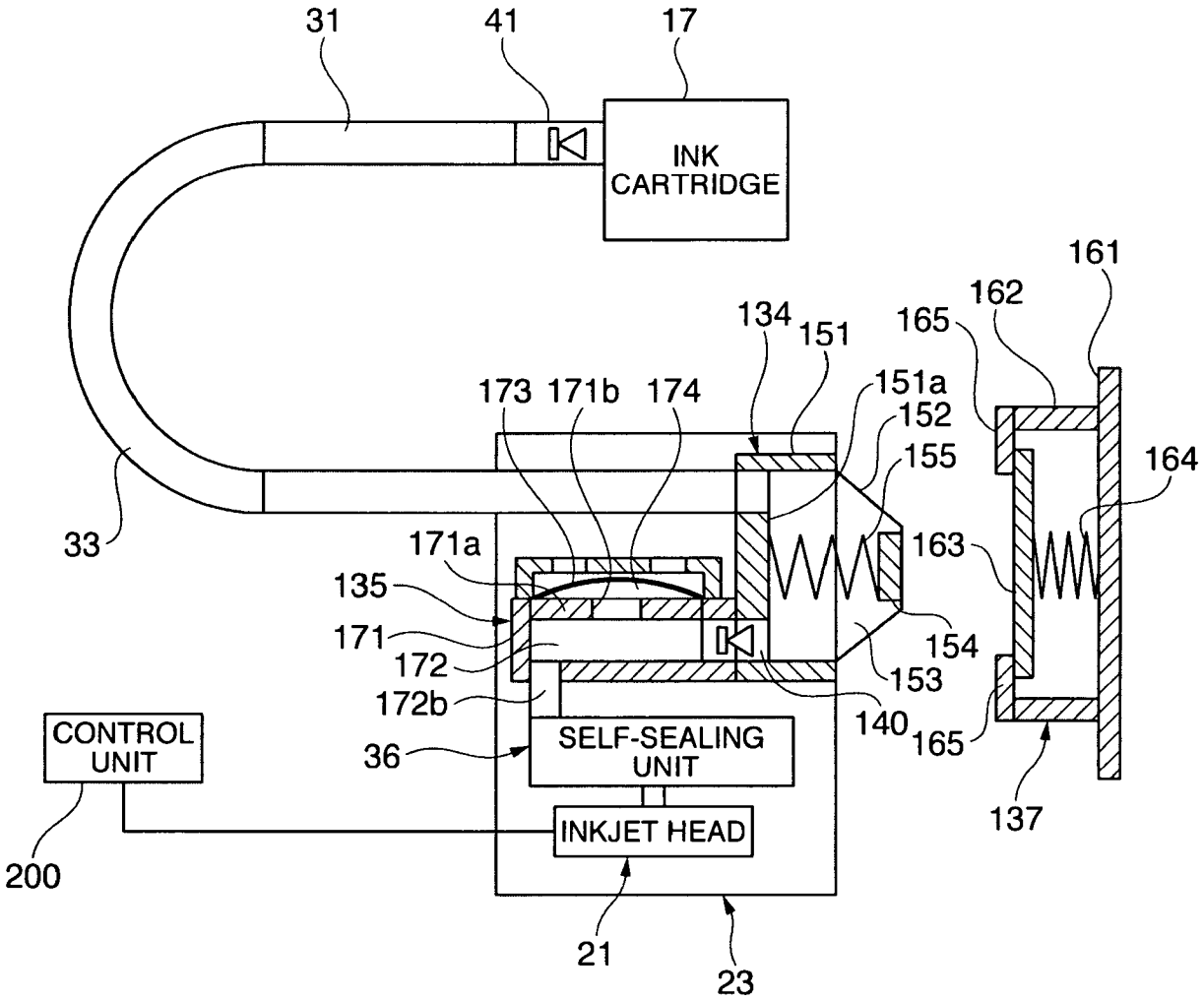
FIG. 17 is a section view showing the main parts of the ink supply mechanism in a second embodiment of the invention.

As shown in FIG. 17 the ink pump unit 134 has a container 151 that communicates with an ink holding unit 135 (subtank) through the ink supply tube 33 and a backflow prevention valve 140. The side part of this container 151 is open, and this open side part is covered by a flexible, fluid-tight film 152. The part of this ink pump unit 134 that is enclosed by the container 151 and film 152 is the ink collection unit 153 (ink chamber).

A pressure plate 154 is disposed in the center part of this film 152, a compression spring 155 (urging member) is disposed between this pressure plate 154 and the bottom 151*a* of the container 151, and the ink collection unit 153 is expanded by the compression spring 155 pushing the film 152 to the outside.

The compression mechanism unit 137 (compression unit) that the ink pump unit 134 can contact has a bracket 162 affixed to aside frame 161, a pressure plate 163 disposed in the space enclosed by the bracket 162, and a compression spring 164 between the pressure plate 163 and side frame 161 that urges the pressure plate 163 to the ink pump unit 134 side. A catch 165 is disposed to the bracket 162 on the ink pump unit 134 side, and this catch 165 engages the edge part of the pressure plate 163 that is urged toward the ink pump unit 134 side by the compression spring 164 so that the pressure plate 163 does not drop out of the bracket 162.

The ink holding unit 135 has a divider wall 171*a* separating the top and bottom inside the holding unit case 171, and the space below the divider wall 171*a* is a flow path 172. The ink pump unit 134 is connected through the backflow prevention valve 140 to the upstream end part 172*a* of the flow path 172, and the self-sealing unit 36 is connected to the downstream end part 172*b*. As a result, ink is delivered from the ink pump unit 134 side through the backflow prevention valve 140 to the flow path 172, and the ink is then fed through this flow path 172 to the self-sealing unit 36.

An elastic wall 173 is affixed to the divider wall 171*a* with a fluid-tight fit around the edges in the top part of the space divided by the divider wall 171*a*. This elastic wall 173 is an elastic sheet made of rubber, for example, and forms an ink holding chamber 174 between itself and the divider wall 171*a*. A communication hole 171*b* is formed in the divider wall 171*a*, and the flow path 172 communicates with the ink holding chamber 174 through this communication hole 171*b*. An air hole 175 is formed in the top part of the holding unit case 171 and the space on this top side is open to the air so that the elastic wall 173 can deform smoothly.

When the pressure of the ink flowing into the flow path 172 of this ink holding unit 135 is positive, the ink inside the flow path 172 flows through the communication hole 171*b* into the ink holding chamber 174. As a result, ink flowing in from the flow path 172 through the communication hole 171*b* causes the elastic wall 173 to expand to the outside, the ink holding chamber 174 thus expands and ink is held inside the ink holding chamber 174. When the ink flow in the flow path 172 goes to a negative pressure, the ink holding chamber 174 shrinks as a result of ink in the ink holding chamber 174 flowing through the communication hole 171*b* into the flow path 172. When all of the ink inside the ink holding chamber 174 flows into the flow path 172, the elastic wall 173 goes in contact with the holding unit case 171.

When the carriage 23 moves toward the compression mechanism unit 137 and the ink pump unit 134 contacts the compression mechanism unit 137 with the ink supply mechanism described above, the pressure plate 154 of the ink pump unit 134 is pushed against the urging force of the compression spring 155 by the pressure plate 163 of the compression mechanism unit 137, and the ink collection unit 153 contracts.

As a result, the ink held in the compressed ink collection unit 153 is fed through the backflow prevention valve 140 to the ink holding unit 135.

The compression spring 164 of the compression mechanism unit 137 is slightly stronger than the compression spring 155 of the ink pump unit 134 and the elastic force of the elastic wall 173 in the ink holding unit 135, and the pressure plate 154 of the ink pump unit 134 is thus pushed reliably by the pressure plate 163 of the compression mechanism unit 137.

When the amount of ink stored in the ink holding chamber 174 goes to a specific substantially full level when the ink pump unit 134 compresses, or when the amount of ink in the ink holding chamber 174 reaches a specific level while the ink pump unit 134 compresses, the flow of ink from the ink pump unit 134 to the ink holding unit 135 stops. As a result, the ink collection unit 153 of the ink pump unit 134 does not shrink, and the pressure plate 163 of the compression mechanism unit 137 is pushed in against the urging force of the compression spring 164.

With the inkjet printer 1 configured as described above, the controller 200 executes the ink refill operation described above at a specific timing during the printing process. Note that this ink supply operation is executed as long as there is at least enough ink left in the ink holding chamber 174 to enable supplying ink to the inkjet head 21 even if printing consumes the maximum amount of ink.

The controller 200 detects when the ink remaining in the ink cartridge 17 has been depleted and the ink cartridge is empty, and reports that it is time to replace the ink cartridge 17.

Figure 18:
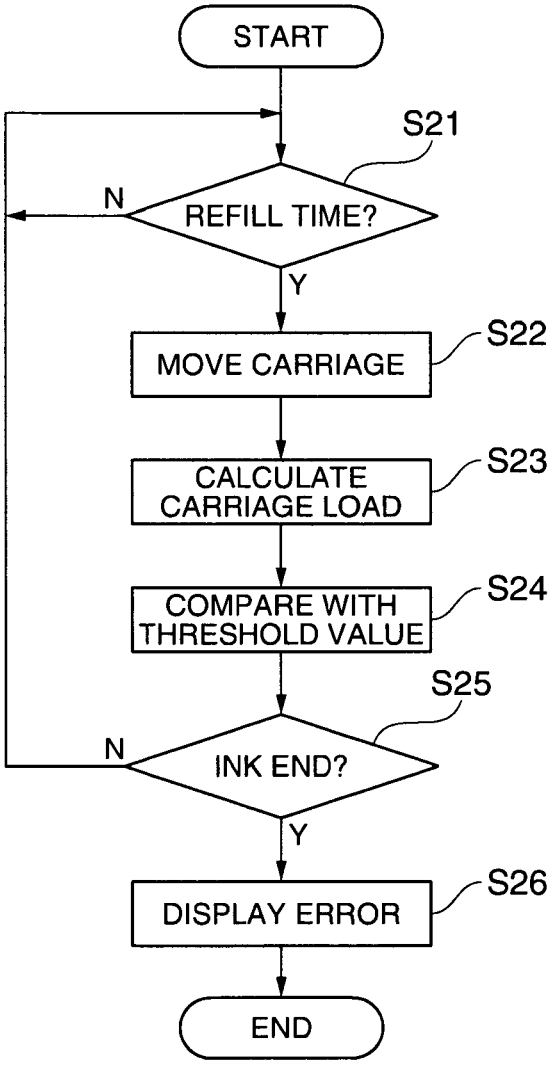
FIG. 18 is a flowchart describing empty ink cartridge detection control by the control unit.
Figure 19:
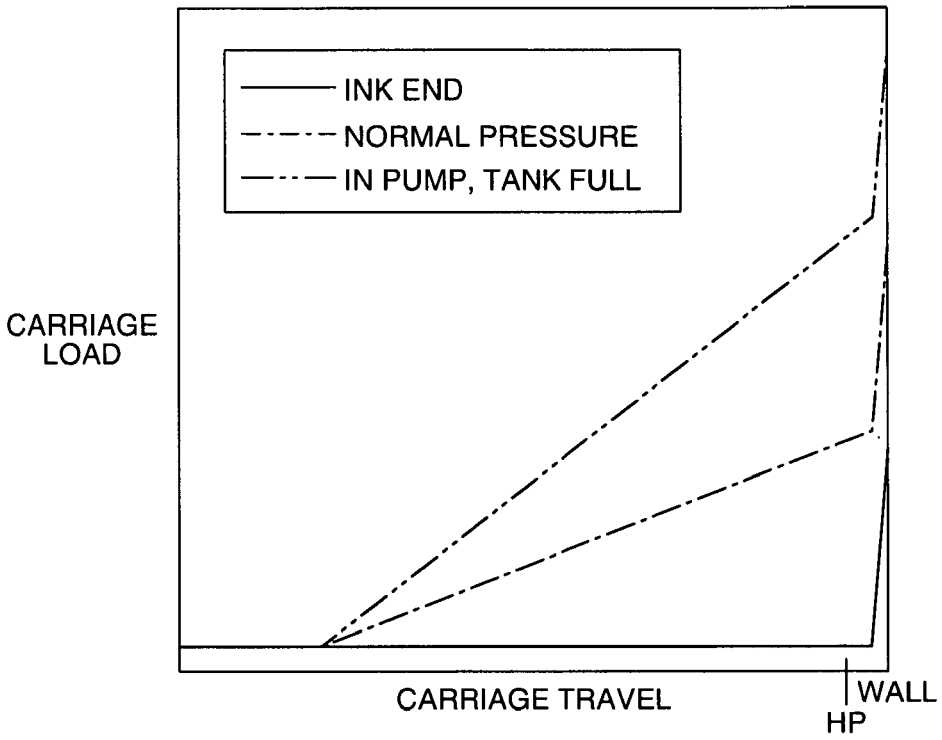
FIG. 19 is a graph showing the relationship between carriage movement and carriage load.

Empty ink cartridge detection control for detecting when the ink cartridge 17 becomes empty is described below with reference to the flowchart in FIG. 18 and the graph in FIG. 19 showing the relationship between carriage movement and carriage load.

The ink refill operation starts at the ink refill timing (step S21 returns Yes), and the carriage 23 moves to the standby position (step S22).

The control unit 100 thus monitors the carriage load from the carriage motor 26*b* current, the carriage motor 26*b* being a DC motor, integrates the carriage load for the carriage 23 movement (step S23), and compares the integral of this carriage load with the preset threshold value (step S24).

If the integral of this carriage load does not reach the preset threshold value, the ink cartridge 17 is determined to be empty (ink end) (step S25 returns Yes).

When the ink cartridge 17 is determined to be empty, the control unit 200 displays an error (step S26) prompting replacing the ink cartridge 17 using the indicators on the front of the printer case 2, for example.

As shown in FIG. 19, when the ink in the ink holding chamber 174 has not been consumed and the chamber is full, the ink collection unit 153 is not compressed. As a result, in this state, only the compression spring 164 of the compression mechanism unit 137 is compressed from the point when the pressure plate 154 of the ink pump unit 134 contacts the pressure plate 163 of the compression mechanism unit 137, and the carriage load increases greatly according to the force of this spring (the double-dot dash line in FIG. 19).

If ink in the ink holding chamber 174 has been consumed, the pressure plate 154 of the ink pump unit 134 is pushed against the urging force of the compression spring 155 and the ink collection unit 153 is compressed from the point when the pressure plate 154 of the ink pump unit 134 contacts the pressure plate 163 of the compression mechanism unit 137, ink is fed into the ink holding chamber 174 and the ink volume increases. As a result, the carriage load increases according to the elastic force of the compression spring 155 of the ink pump unit 134 from the point when the pressure plate 154 of the ink pump unit 134 contacts the pressure plate 163 of the compression mechanism unit 137.

Furthermore, because ink is not supplied from the ink cartridge 17 if the ink cartridge 17 is empty of ink and the pressure plate of the ink pump unit 134 is pressed, the compressed ink collection unit 153 is held in the shrunken state.

If the carriage 23 moves the home position (HP) in this condition, the pressure plate 154 of the ink pump unit 134 does not contact the pressure plate 163 of the compression mechanism unit 137, and the carriage load is therefore constant to the home position (HP), which is the standby position (the solid line in FIG. 19).

The carriage load thus differs greatly when the ink cartridge 17 is depleted of ink and when ink remains. It is therefore possible to quickly and easily determine if the ink cartridge 17 is empty (ink end) based on the integral of the carriage load of moving the carriage 23.

As described above, because the controller 200 determines if there is ink in the ink cartridge 17 based on the load required to move the carriage 23 in a configuration whereby ink is drawn from the ink cartridge 17 as a result of compression by the force of carriage 23 movement against the urging force of a compression spring 155, the presence of ink in the ink cartridge 17 can be highly accurately determined without providing a separate detection unit. As a result, the ink cartridge 17 can be replaced or refilled with ink at an appropriate time, and ink waste can be significantly suppressed.

The difference in the carriage load the first and second times the carriage 23 moves thus also differs greatly in this second embodiment of the invention between when the ink cartridge 17 is empty of ink and when ink remains. Therefore, as in the first variation of the first embodiment, this second embodiment can accurately determine if ink is in the ink cartridge 17 by comparing the carriage loads of the first and second times the carriage 23 moves.

In addition, the carriage loads in the normal load area A and the ink refill load area B when the carriage 23 moves toward the standby position after the ink refill operation differ greatly between when the ink cartridge 17 is empty of ink and when ink is left. Therefore, as in the second variation of the first embodiment, this second embodiment can determine with a high degree of accuracy if ink is in the ink cartridge 17 by comparing the carriage loads in the normal load area A and the ink refill load area B.

Third Embodiment

A third embodiment of the invention is described next.

The first embodiment and second embodiment determine if ink is present in the ink cartridge 17 based only on the load of carriage 23 movement, but the load of carriage 23 movement will also vary greatly when there is a paper jam caused by the print medium entering the range of carriage 23 movement. A method of accurately determining in this situation if ink is in the ink cartridge 17 is described next as a third embodiment of the invention with reference to FIGS. 20-22.

This third embodiment is described below using the same reference numerals to refer to parts with the same or similar function in the first embodiment.

Figure 20:
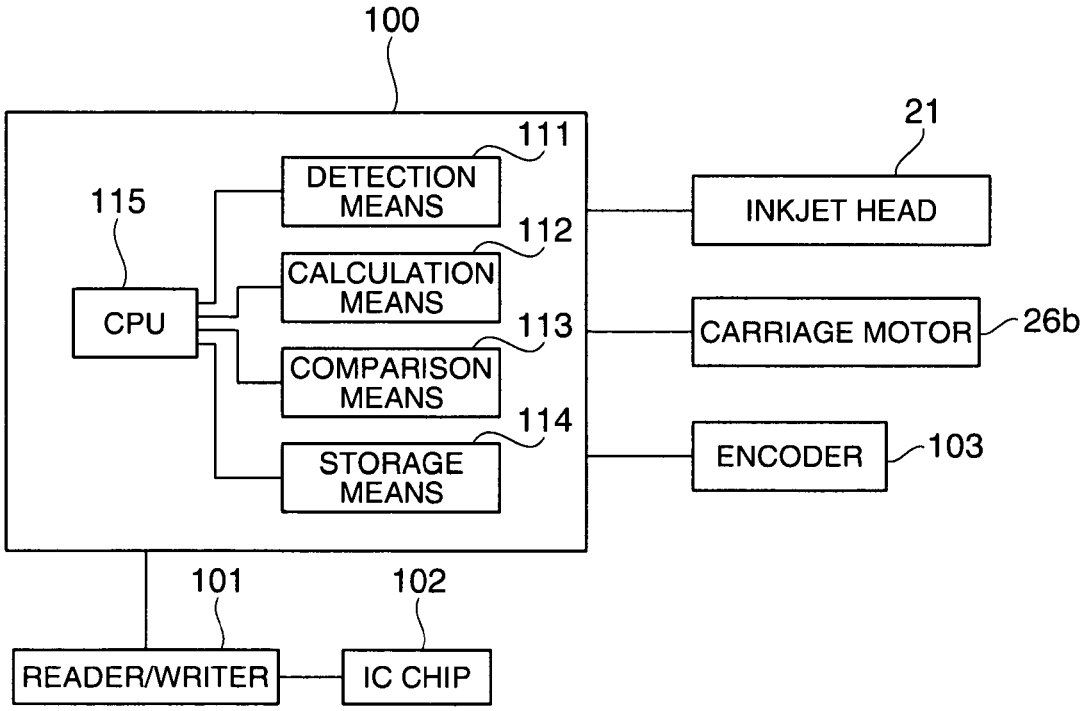
FIG. 20 is a block diagram describing the control system in a third embodiment of the invention.

As shown in FIG. 20, the control unit 100 (controller) of the inkjet printer 1 controls driving the inkjet head 21 and the carriage motor **26*b* by sending control signals to the inkjet head 21 and the carriage motor 26*b* to, for example, print on the roll paper 11**.

A reader/writer 101 is connected to the control unit 100. The reader/writer 101 reads and writes ink usage history information in an IC chip 102 disposed to the ink cartridge 17. The ink usage history information written to the IC chip 102 includes, for example, the remaining ink volume, the waste ink volume, the date of first use, and device information denoting the device using the ink cartridge 17, for example. Other information, such as the ink type, is also stored in the IC chip 102 in addition to the ink usage history information.

The control unit 100 reads the ink usage history information stored in the IC chip 102 of the ink cartridge 17 loaded in the cartridge loading unit 15 by the reader/writer 101. If the loaded ink cartridge 17 is new, the date of first use and the device information is written to the IC chip 102.

The control unit 100 of this inkjet printer 1 executes a paper jam and ink presence detection process (abnormal load determination process).

Figure 21:
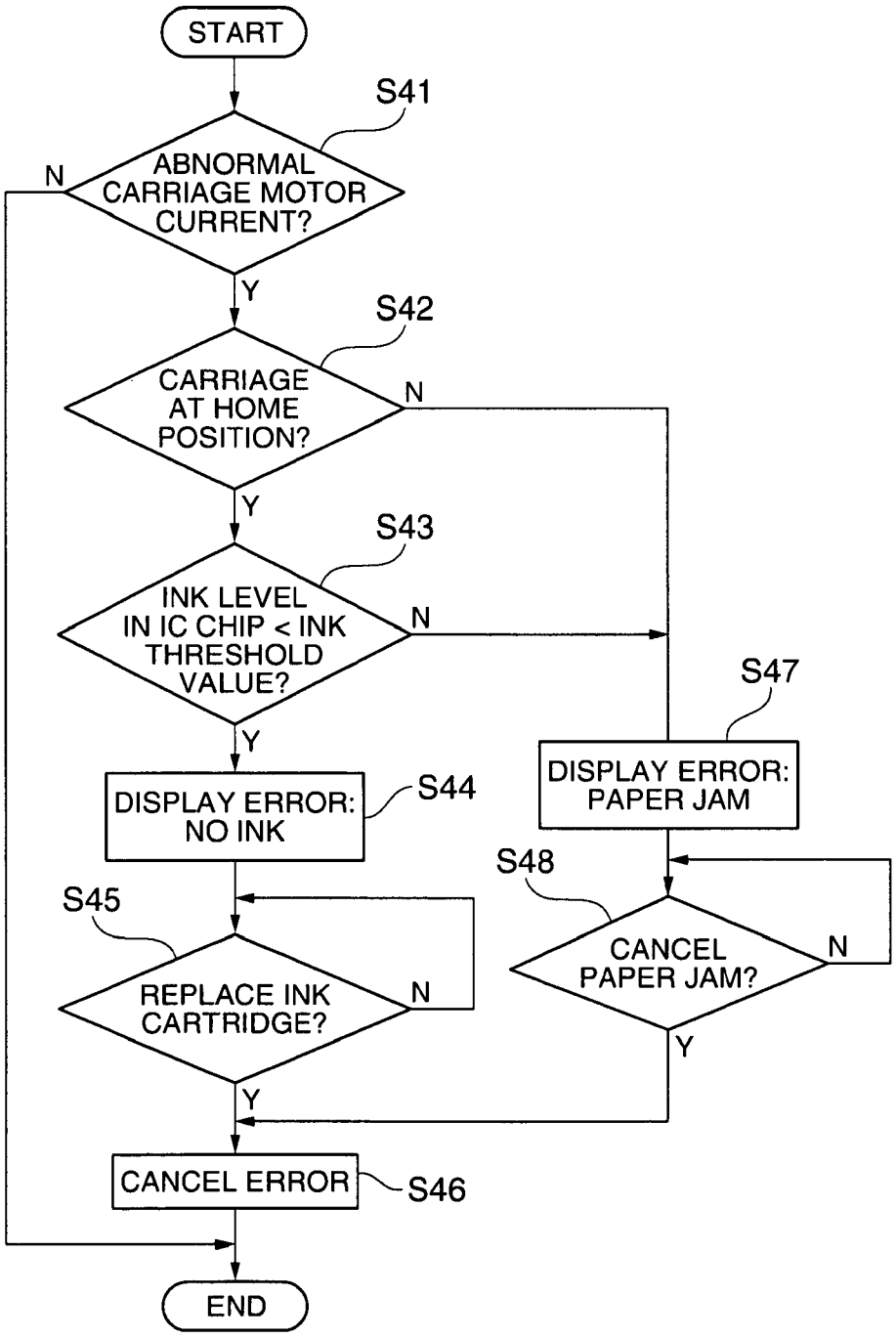
FIG. 21 is a flow chart describing a paper jam and ink presence detection process of the control unit.

This paper jam and ink presence detection process is described next with reference to the flow chart in FIG. 21.

The control unit 100 monitors if the current of the carriage motor **26*b* that drives the carriage 23 is unusual, and determines if the carriage 23 load variation is unusual (step S41**).

When the roll paper 11 enters the range of carriage 23 or inkjet head 21 movement, the load of carriage 23 movement also rises greatly and the carriage motor **26*b* current varies greatly if the roll paper 11 catches the carriage 23 or inkjet head 21** and a paper jam occurs.

A threshold value stored in the storage unit 114 is set based on these two conditions under which the carriage motor **26*b*** current varies greatly.

If the variation in the load needed to move the carriage 23 is abnormal (step S41 returns Yes), the control unit 100 determines based on the signal from the encoder 103 if the carriage 23 is in the standby position (refill position), which is the home position (step S42).

If the carriage 23 is determined not to be in the home position (step S42 returns No), an abnormal change in the carriage 23 load has occurred without the ink refill operation, the control unit 100 therefore determines that a carriage movement problem has occurred, such as a paper jam caused by the roll paper 11 catching the inkjet head 21, and displays a paper jam error using the indicators on the front of the printer case 2, for example (step S47).

When the paper jam is then removed by the user (step S48 returns Yes), the control unit 100 cancels the paper jam error display (step S46).

If the step of determining if the carriage 23 is in the home position, which is the standby position, (step S42) determines that the carriage 23 is at the home position (step S42 returns Yes), the control unit 100 determines if the remaining ink volume stored in the IC chip 102 of the ink cartridge 17 is less than the ink threshold value (fluid threshold value) (step S43).

If the remaining ink volume is not less than the ink threshold value (step S43 returns No), that is, if the remaining ink volume is greater than or equal to the ink threshold value, the control unit 100 decides that the carriage 23 moved to the home position while the paper is jammed, and displays a paper jam error using the indicators on the front of the printer case 2, for example (step S47).

When the paper jam is then removed by the user (step S48 returns Yes), the control unit 100 cancels the paper jam error display (step S46).

If the step (step S43) of determining if the remaining ink volume is less than the ink threshold value determines that the remaining ink volume is less than the threshold value (step S43 returns Yes), the control unit 100 decides that the ink cartridge 17 is empty (ink end) and displays a no-ink error using the indicators on the front of the printer case 2, for example (step S44).

After the user then replaces the ink cartridge 17 (step S45 returns Yes), the control unit 100 cancels the no-ink error display (step S46).

The control unit 100 regularly executes a process to determine if ink is present in the ink cartridge 17 (regular fluid presence detection process) at a specific timing separately to the paper jam and ink presence detection process described above.

Figure 22:
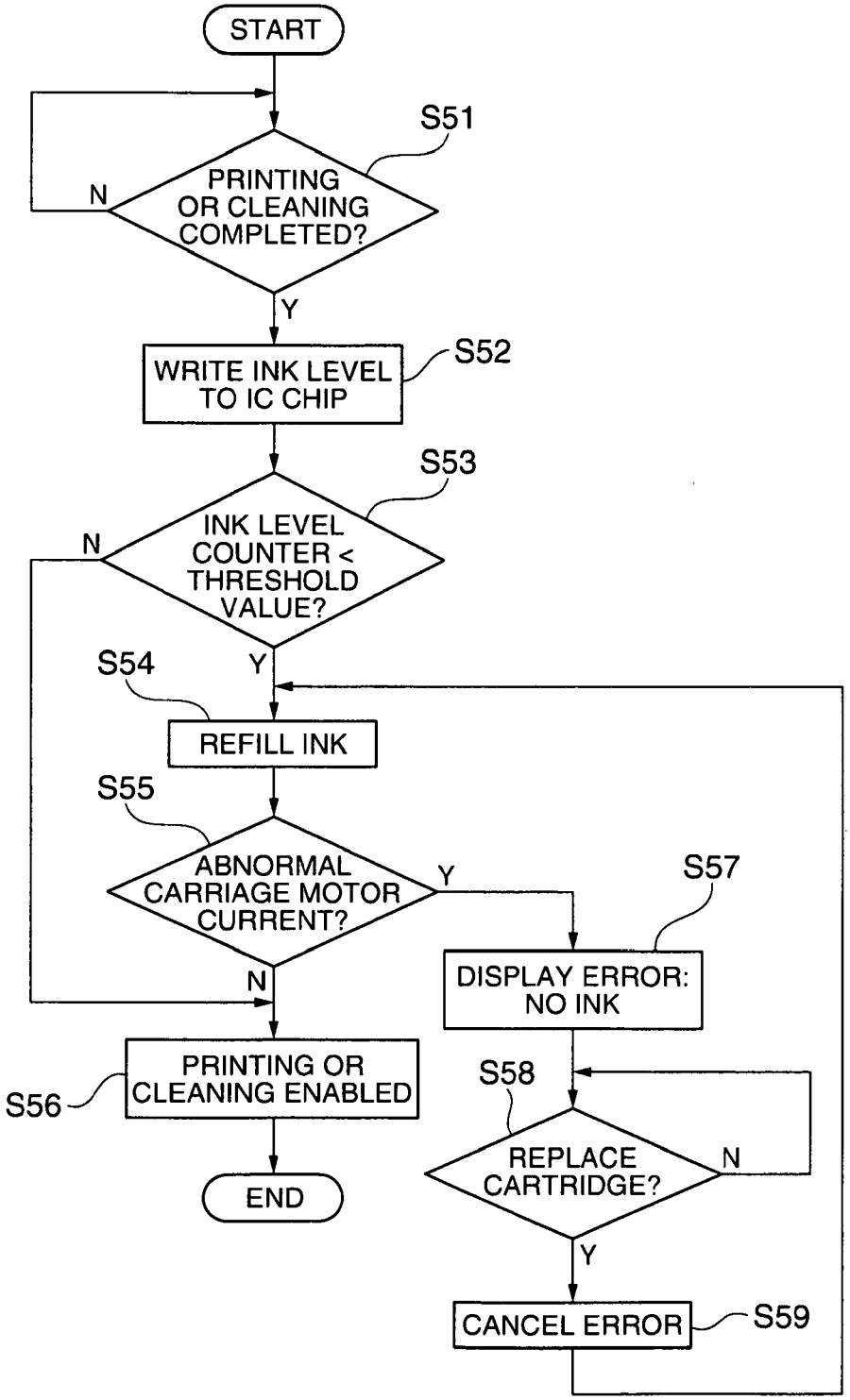
FIG. 22 is a flow chart describing a regular ink presence detection process of the control unit.

This regular ink presence detection process is described next with reference to the flow chart in FIG. 22.

If the printing process of the inkjet head 21 or the inkjet head 21 cleaning process of the ink vacuum mechanism 29 has ended (step S51 returns Yes), the control unit 100 immediately determines the remaining ink volume in the ink cartridge 17 based on the volume of ink consumed in the printing process or the cleaning process, and writes the remaining ink volume as ink usage history information to the IC chip 102 (step S52).

At this time the control unit 100 compares the remaining ink volume count written to the expansion mechanism 52 of the ink cartridge 17 with a specific preset value, and determines if the remaining ink volume count is less than the specific value (step S53).

The specific value used for reference here is the ink volume required for the printing process or the cleaning process.

If the remaining ink volume count is determined to be greater than or equal to the specific value (step S53 returns No), the control unit 100 determines that there is enough ink remaining in the ink cartridge 17 to execute at least the next printing process or cleaning process (step S56), and the regular ink presence detection process ends.

If the step (step S53) of determining if the remaining ink volume count is less than the specific value determines that the remaining ink volume count is less than the specific value (step S53 returns Yes), the control unit 100 executes the ink refill operation (step S54).

In step S54 the carriage 23 is moved toward the standby position (refill position), that is, the home position, in order to draw ink from the ink cartridge 17 in the ink pump unit 34.

The control unit 100 then monitors an abnormal change in the carriage motor 26*b* current used to drive the carriage 23, and determines if the change in carriage 23 load is abnormal (step S55).

As described above, if the carriage 23 is moved to the standby position to refill using ink from the ink cartridge 17 when the ink cartridge 17 is substantially empty, ink will not be drawn into the ink chamber 50 and the coil tension spring 57 will extend even when the rocker arm 56 of the subtank 45 of the ink pump unit 34 contacts the regulator panel 37, the carriage 23 load increases greatly according to the force of the spring, and the carriage motor 26*b* current changes greatly. Therefore, whether the ink cartridge 17 is empty (ink end) or not can be determined by determining if the change in the carriage 23 load causing the carriage motor 26*b* current to rise rapidly is abnormal.

As a result, if it is determined that the change in carriage 23 load is abnormal (step S55 returns Yes), the control unit 100 decides that the ink cartridge 17 is empty (ink end), and displays a no-ink error using the indicators on the front of the printer case 2, for example (step S57).

When the user replaces the ink cartridge 17 (step S58), the control unit 100 cancels the no-ink error display (step S59) and repeats the ink refill operation drawing ink from the ink cartridge (step S54).

If the step of determining if the carriage motor 26*b* current is abnormal (step S55) decides that an abnormal carriage motor 26*b* current problem has not occurred (step S55 returns No), the control unit 100 decides that the remaining ink volume is sufficient to enable at least the next printing process or cleaning process (step S56), and the regular ink presence detection process ends.

This embodiment of the invention compares the integrals of the carriage load based on the carriage motor 26*b* current, but the invention is not so limited to calculating an integral, and the carriage motor current could be determined to be abnormal if the actual carriage motor 26*b* current exceeds a specific value, for example. Because problems can be immediately detected in this situation, power to the carriage motor 26*b*, which is commonly a DC motor, can be quickly interrupted and carriage motor 26*b* burnout can be prevented when a paper jam occurs. Furthermore, because the carriage load can be observed from the carriage speed, because the carriage speed drops when the load rises, the movement per unit time can be detected and an abnormal load can be detected if the speed drops greatly or if the speed drops below a specific speed.

In addition, the expansion mechanism 52 in this embodiment of the invention is described using a rocker arm 56 that is pivotably supported as an engaging member, but the engaging member may be rendered slidably in the same direction as the direction of piston 54 movement and the engaging member may move in conjunction with carriage 23 movement.

The regular ink presence detection process (regular fluid presence detection process) of the ink cartridge 17 is executed at a specific timing, but may be executed at a specific interval, such as every job as in this embodiment of the invention.

The remaining ink volume is used by way of example in this embodiment of the invention as information relating to the ink volume stored in the IC chip 102 of the ink cartridge 17 loaded in the cartridge loading unit 15, but the ink consumption volume may be used instead. If the ink consumption volume is used, step S43 in FIG. 21 can determine if the ink consumption volume stored in the IC chip is greater than or equal to a threshold value. Likewise, step S52 in FIG. 22 is changed to write the ink consumption volume in the IC chip, and step S53 changes to decide if the ink consumption volume count is greater than or equal to a specific value.

As described above, when the change in the load of the moving carriage 23 is determined to be abnormal, the embodiment described above executes a paper jam and ink presence detection process that determines there is no ink in the ink cartridge 17 if the remaining ink volume stored in the IC chip 102 is less than the ink threshold value, and determines there is a carriage 23 movement error if the remaining ink volume stored in the IC chip 102 is greater than or equal to the ink threshold value. As a result, the presence of ink in the ink cartridge 17 and whether there is a paper jam or other problem with carriage 23 movement can be determined easily with great accuracy without providing a separate detection unit. As a result, the ink cartridge 17 can be replaced or refilled with ink at an appropriate time, and carriage 23 movement problems can be quickly resolved.

Furthermore, if an ink cartridge 17 is removed before being depleted and a partially used ink cartridge 17 is then reloaded, the presence of ink can be reliably detected from the information stored in the IC chip 102, and the device cost and size can be reduced because a separate sensor or other detector for detecting carriage 23 movement problems is not needed.

Furthermore, because the paper jam and ink presence detection process executes when the position of the carriage 23 is the ink refill position of the ink pump unit 34, which is the standby position (home position), and a carriage 23 movement problem caused, for example, by a paper jam, is detected if the position of the carriage 23 is other than the standby position, carriage 23 movement problems and whether ink is in the ink cartridge 17 can be accurately determined according to the position of the carriage 23.

In addition, because a regular ink presence detection process that determines there is no ink in the ink cartridge 17 is executed if the load change of the moving carriage 23 is abnormal from when the remaining ink volume stored in the IC chip 102 goes to less than a specific value that is the ink volume required for the inkjet head 21 to execute the printing process or for the cleaning process that vacuums ink from the inkjet head 21, the process of determining if there is ink in the ink cartridge 17 can be eliminated when the ink left in the ink cartridge 17 is at least enough for the printing process or the cleaning process, and control and processing can be simplified.

Furthermore, because the regular ink presence detection process executes directly after the printing process or cleaning process, decision errors caused by differences in the actual remaining ink volume and the remaining ink volume stored in the IC chip 102 can be significantly reduced, and an accurate decision can be acquired from the regular ink presence detection process.

In addition to inkjet printers as described above, the fluid discharge device according to embodiments of the present the invention can be applied in fluid discharge devices equipped with fluid discharge heads for discharging a variety of fluids, including color agent discharge heads used in manufacturing color filters for liquid crystal displays, electrode material discharge heads used for forming electrodes in organic EL display and FED (field emission display) devices, and bio-organic material discharge heads used in biochip manufacture. The invention can also be used in a reagent discharge device as a precision pipette.

The concept of a fluid also includes gels, high viscosity materials, and mixtures of a solid in a solvent, and the concept of an ink includes aqueous inks and oil-based inks.

Although the preferred embodiments of the present invention has been described with reference to the accompanying drawings, it is to be noted that various changes and modifications will be apparent to those skilled in the art. Such changes and modifications are to be understood as included within the scope of the present invention as defined by the appended claims.

What is claimed is:

1. A control method for a fluid discharge device, comprising:

moving a carriage on which a fluid discharge head and a subtank are mounted from a first position to a second position such that a rocker arm protruding from the carriage contacts a portion of the fluid discharge device outside of the carriage and causes fluid stored in a sealed storage unit of variable capacity to be drawn into the subtank; and determining whether fluid is in the sealed storage unit of variable capacity based on a load required to move the carriage.

2. The control method for a fluid discharge device described in claim 1, wherein:

determining whether fluid is in the sealed storage unit of variable capacity includes comparing an integral of a load required for moving the carriage with a preset threshold value.

3. The control method for a fluid discharge device described in claim 1, wherein:

determining whether fluid is in the sealed storage unit of variable capacity includes comparing a load required to move the carriage at a specific position with a preset threshold value.

4. The control method for a fluid discharge device described in claim 1, wherein:

determining whether fluid is in the sealed storage unit of variable capacity includes comparing the second position of the carriage when a rated load is applied to move the carriage from the first position to the second position with a preset reference position.

5. The control method for a fluid discharge device described in claim 1, wherein:

determining whether fluid is in the sealed storage unit of variable capacity includes comparing a load required to move the carriage during a first carriage movement and a load required to move the carriage during a second carriage movement.

6. The control method for a fluid discharge device described in claim 1, wherein:

determining whether fluid is in the sealed storage unit of variable capacity includes comparing a load required to move the carriage in a fluid refill load area where a fluid refill operation can occur and a normal load area where the fluid refill operation does not occur when the carriage is moved after the fluid refill operation by the refill mechanism.

7. The control method for a fluid discharge device described in claim 1, wherein:

determining whether fluid is in the sealed storage unit of variable capacity includes comparing an integral of a load required to move the carriage in a fluid refill load area where a fluid refill operation can occur and an integral of a load required to move the carriage an equal distance in a normal load area where the fluid refill operation does not occur.

8. The control method for a fluid discharge device described in claim 1, wherein:

determining whether fluid is in the sealed storage unit of variable capacity includes comparing an average load required to move the carriage in a fluid refill load area where a fluid refill operation can occur and an average load required to move the carriage in a normal load area where the fluid refill operation does not occur.

9. The control method for a fluid discharge device described in claim 1, further comprising:

writing an amount of fluid in the sealed storage unit of variable capacity to a storage unit disposed in the sealed storage unit of variable capacity.

10. The control method for a fluid discharge device described in claim 9, further comprising:

determining that there is a carriage movement error when variation in the load required to move the carriage is abnormal and the amount of fluid written to the storage unit is greater than or equal to a fluid threshold value.

11. The control method for a fluid discharge device described in claim 9, further comprising:

determining that there is a carriage movement error when variation in the load required to move the carriage is abnormal and a position of the carriage is other than a fluid refill position of the refill mechanism.

* * * * *